US010504427B2

(12) United States Patent
Yang et al.

(10) Patent No.: US 10,504,427 B2
(45) Date of Patent: Dec. 10, 2019

(54) PIXEL DRIVING CIRCUIT AND DRIVING METHOD THEREOF, AND DISPLAY PANEL

(71) Applicant: BOE TECHNOLOGY GROUP CO., LTD., Beijing (CN)

(72) Inventors: Shengji Yang, Beijing (CN); Xue Dong, Beijing (CN); Jing Lv, Beijing (CN); Xiaochuan Chen, Beijing (CN); Lei Wang, Beijing (CN); Dongni Liu, Beijing (CN); Pengcheng Lu, Beijing (CN); Jie Fu, Beijing (CN); Han Yue, Beijing (CN); Li Xiao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 41 days.

(21) Appl. No.: 15/776,583

(22) PCT Filed: Oct. 25, 2017

(86) PCT No.: PCT/CN2017/107658

§ 371 (c)(1),
(2) Date: May 16, 2018

(87) PCT Pub. No.: WO2018/149167

PCT Pub. Date: Aug. 23, 2018

(65) Prior Publication Data

US 2019/0279565 A1 Sep. 12, 2019

(30) Foreign Application Priority Data

Feb. 14, 2017 (CN) ..... 2017 1 0079035

(51) Int. Cl.
*G09G 5/02* (2006.01)
*G09G 3/3233* (2016.01)
(Continued)

(52) U.S. Cl.
CPC ..... *G09G 3/3233* (2013.01); *G09G 3/3266* (2013.01); *G09G 3/3275* (2013.01); *G09G 2310/061* (2013.01)

(58) Field of Classification Search
CPC ..... G09G 2300/043; G09G 2300/0814; G09G 2300/0819; G09G 2300/0842;
(Continued)

(56) References Cited

U.S. PATENT DOCUMENTS 9,082,344 B2 * 7/2015 Shin ..... G09G 3/3233
2006/0022909 A1 2/2006 Kwak
(Continued)

FOREIGN PATENT DOCUMENTS

CN 1737894 A 2/2006
CN 105185305 A 12/2015
(Continued)

OTHER PUBLICATIONS

International Search Report dated Jan. 25, 2018.

*Primary Examiner* — Insa Sadio
(74) *Attorney, Agent, or Firm* — Dilworth & Barrese, LLP.; Michael J. Musella, Esq.

(57) ABSTRACT

A pixel driving circuit and driving method thereof, and a display panel are provided. The pixel driving circuit includes: a data writing circuit, a reset circuit, a storage circuit, a compensation control circuit, a light emission control circuit, a driving transistor and a plurality of light emitting devices. The pixel driving circuit can time-divisionally input the data signal of the data signal terminal through the data writing circuit, and time-divisionally, electrically conduct each light emitting device and the second electrode of the driving transistor through the light emission
(Continued)

control circuit, thereby realizing the function of controlling a plurality of light emitting devices to time-divisionally emit light.

15 Claims, 14 Drawing Sheets

(51) Int. Cl.
*G09G 3/3266* (2016.01)
*G09G 3/3275* (2016.01)

(58) Field of Classification Search
CPC ... G09G 2310/0251; G09G 2320/0233; G09G 2320/045; G09G 3/3233; G09G 3/3258
See application file for complete search history.

(56) References Cited

U.S. PATENT DOCUMENTS

2013/0271501 A1* 10/2013 Yang ..... G09G 3/3233 345/690
2017/0270860 A1 9/2017 Wang et al.

FOREIGN PATENT DOCUMENTS

CN 106448566 A 2/2017
CN 107068057 A 8/2017
WO 2016141777 A2 9/2016

* cited by examiner

PIXEL DRIVING CIRCUIT AND DRIVING METHOD THEREOF, AND DISPLAY PANEL

TECHNICAL FIELD

Embodiments of the present disclosure relate to a pixel driving circuit and a driving method thereof, and a display panel.

BACKGROUND

Organic light emitting diodes (OLEDs) involve one of the hotspots in the research field of flat panel displays nowadays. Compared with liquid crystal displays (LCDs), OLED displays have the advantages such as low energy consumption, low production cost, self-luminescence, wide viewing angle, and fast response speed. At present, OLED displays have begun to replace traditional LCD displays in display areas such as mobile phone, tablet computer, digital camera and so on.

At present, in an OLED display, the value of pixels per inch (PPI, i.e., pixels number per inch) of an OLED display is mainly restricted by the production process and the size of used fine metal mask (FMM, i.e., high-precision metal mask). However, when the production process level rises to a certain level, the PPI value of an OLED display is mainly determined by the aperture size of used FMM. In order to improve display quality, an OLED display needs a higher PPI value. In the available display panel, each pixel has a pixel compensation circuit, thereby resulting in that the display panel cannot achieve a high PPI value.

SUMMARY

At least one embodiment of the present disclosure provides a pixel driving circuit, comprising: a data writing circuit, a reset circuit, a storage circuit, a compensation control circuit, a light emission control circuit, a driving transistor and a plurality of light emitting devices; wherein the data writing circuit is configured to provide a data signal of a data signal terminal to the storage circuit; the reset circuit is configured to reset a control electrode of the driving transistor; the storage circuit is configured to store the data signal and a threshold voltage of the driving transistor; the compensation control circuit is configured to electrically conduct the control electrode of the driving transistor and a second electrode of the driving transistor, so that the storage circuit is capable of storing the threshold voltage of the driving transistor to compensate the driving transistor; a first electrode of the driving transistor is configured to be connected to a first power supply terminal; and the light emission control circuit is configured to be connected to light emission control signal terminals one-to-one corresponding to the light emitting devices, the second electrode of the driving transistor and a first terminal of each of the light emitting devices, a second terminal of each of the light emitting devices is connected to a second power supply terminal, and the light emission control circuit is configured to time-divisionally electrically conduct the first terminals of the light emitting devices respectively corresponding to the light emission control signal terminals and the second electrode of the driving transistor under control of each of the light emission control signal terminals to control the light emitting devices to emit light.

For example, in the pixel driving circuit provided by at least one embodiment of the present disclosure, the data writing circuit is configured to be respectively connected to a first scanning signal terminal, the data signal terminal and a first node, and time-divisionally provide the data signal of the data signal terminal to the first node under control of the first scanning signal terminal; the reset circuit is configured to be respectively connected to a reset signal terminal, an initial signal terminal and the control electrode of the driving transistor, and provide a signal of the initial signal terminal to the control electrode of the driving transistor under control of the reset signal terminal; the storage circuit is configured to be respectively connected to the first node and the control electrode of the driving transistor, charge or discharge under control of a signal of the first node and a signal of the control electrode of the driving transistor, and keep a voltage difference between the first node and the control electrode of the driving transistor stable when the control electrode of the driving transistor is in a floating state; and the compensation control circuit is configured to be respectively connected to a second scanning signal terminal, the control electrode of the driving transistor and the second electrode of the driving transistor, and electrically conduct the control electrode of the driving transistor and the second electrode of the driving transistor under control of the second scanning signal terminal.

For example, in the pixel driving circuit provided by at least one embodiment of the present disclosure, each of the light emitting devices corresponds to a sub-pixel, and the light emission control circuit comprises: light emission control sub-circuits one-to-one corresponding to light emitting devices; wherein each light emission control sub-circuit is respectively connected to the first terminal of the corresponding light emitting device, the light emission control signal terminal corresponding to the corresponding light emitting device and the second electrode of the driving transistor; and the light emission control sub-circuit is used to electrically conduct the second electrode of the driving transistor and the first terminal of the connected light emitting device under control of the connected light emission control signal terminal.

For example, in the pixel driving circuit provided by at least one embodiment of the present disclosure, the light emitting devices comprise: a red light emitting device, a green light emitting device and a blue light emitting device; the light emission control circuits comprises a red light emission control sub-circuit, a green light emission control sub-circuit and a blue light emission control sub-circuit; the red light emission control sub-circuit is respectively connected to a first terminal of the red light emitting device, a red light emission control signal terminal corresponding to the red light emitting device and the second electrode of the driving transistor; and the red light emission control sub-circuit is used to electrically conduct the first terminal of the red light emitting device and the second electrode of the driving transistor under control of the red light emission control signal terminal; the green light emission control sub-circuit is respectively connected to a first terminal of the green light emitting device, a green light emission control signal terminal corresponding to the green light emitting device and the second electrode of the driving transistor; and the green light emission control sub-circuit is used to electrically conduct the first terminal of the green light emitting device and the second electrode of the driving transistor under control of the green light emission control signal terminal; and the blue light emission control sub-circuit is respectively connected to a first terminal of the blue light emitting device, a blue light emission control signal terminal corresponding to the blue light emitting device and the second electrode of the driving transistor; and the blue light emission control sub-circuit is used to electrically conduct the first terminal of the blue light emitting device and the second electrode of the driving transistor under control of the blue light emission control signal terminal.

For example, in the pixel driving circuit provided by at least one embodiment of the present disclosure, the red light emission control sub-circuit comprises: a first switching transistor; and a control electrode of the first switching transistor is connected to the red light emission control signal terminal, a first electrode of the first switching transistor is connected to the second electrode of the driving transistor, and a second electrode of the first switching transistor is connected to the first terminal of the red light emitting device.

For example, in the pixel driving circuit provided by at least one embodiment of the present disclosure, the green light emission control sub-circuit comprises: a second switching transistor; and a control electrode of the second switching transistor is connected to the green light emission control signal terminal, a first electrode of the second switching transistor is connected to the second electrode of the driving transistor, and a second electrode of the second switching transistor is connected to the first terminal of the green light emitting device.

For example, in the pixel driving circuit provided by at least one embodiment of the present disclosure, the blue light emission control sub-circuit comprises: a third switching transistor; and a control electrode of the third switching transistor is connected to the blue light emission control signal terminal, a first electrode of the third switching transistor is connected to the second electrode of the driving transistor, and a second electrode of the third switching transistor is connected to the first terminal of the blue light emitting device.

For example, in the pixel driving circuit provided by at least one embodiment of the present disclosure, the data writing circuit comprises: a fourth switching transistor; and a control electrode of the fourth switching transistor is connected to the first scanning signal terminal, a first electrode of the fourth switching transistor is connected to the data signal terminal, and a second electrode of the fourth switching transistor is connected to the first node.

For example, in the pixel driving circuit provided by at least one embodiment of the present disclosure, the reset circuit comprises: a fifth switching transistor; and a control electrode of the fifth switching transistor is connected to the reset signal terminal, a first electrode of the fifth switching transistor is connected to the initial signal terminal, and a second electrode of the fifth switching transistor is connected to the control electrode of the driving transistor.

For example, in the pixel driving circuit provided by at least one embodiment of the present disclosure, the compensation control circuit comprises: a sixth switching transistor; and a control electrode of the sixth switching transistor is connected to the second scanning signal terminal, a first electrode of the sixth switching transistor is connected to the control electrode of the driving transistor, and a second electrode of the sixth switching transistor is connected to the second electrode of the driving transistor.

For example, in the pixel driving circuit provided by at least one embodiment of the present disclosure, the storage circuit comprises a capacitor; and the capacitor is connected between the first node and the control electrode of the driving transistor.

For example, the pixel driving circuit provided by at least one embodiment of the present disclosure further comprises: a seventh switching transistor; wherein the first power supply terminal is connected to the first electrode of the driving transistor through the seventh switching transistor; and a control electrode of the seventh switching transistor is connected to a writing control signal terminal, a first electrode of the seventh switching transistor is connected to the first power supply terminal, and a second electrode of the seventh switching transistor is connected to the first electrode of the driving transistor.

For example, in the pixel driving circuit provided by at least one embodiment of the present disclosure, the driving transistor is a P-type transistor or an N-type transistor.

Another embodiment of the present disclosure provides a display panel, comprising any one of the pixel driving circuits described above.

Further another embodiment of the present disclosure provides a driving method of any one of the pixel driving circuits described above, comprising: a first phase, a second phase and a third phase; wherein the third phase comprises light emitting phases each having a data writing bootstrap sub-phase and a light emitting sub-phase; in the first phase, the reset circuit resets the control electrode of the driving transistor; in the second phase, the data writing circuit provides an initial data signal provided by the data signal terminal to the storage circuit, and the compensation control circuit electrically conducts the control electrode and the second electrode of the driving transistor, so that the storage circuit stores the threshold voltage of the driving transistor; in the third phase, during each of the light emitting phases, in the data writing bootstrap sub-phase, the data writing circuit provides a light emitting data signal provided by the data signal terminal to the storage circuit; and the storage circuit applies a driving voltage on the basis of the initial data signal, the light emitting data signal and the threshold voltage to a gate electrode of the driving transistor; and in the light emitting sub-phase, the light emission control circuit electrically conducts the first terminal of the light emitting device corresponding to the light emission control signal terminal and the second electrode of the driving transistor under control of the light emission control signal terminal corresponding to the light emitting data signal of the data signal terminal to control the light emitting device to emit light.

BRIEF DESCRIPTION OF THE DRAWINGS

In order to clearly illustrate the technical solution of the embodiments of the disclosure, the drawings of the embodiments will be briefly described in the following. It is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1A:
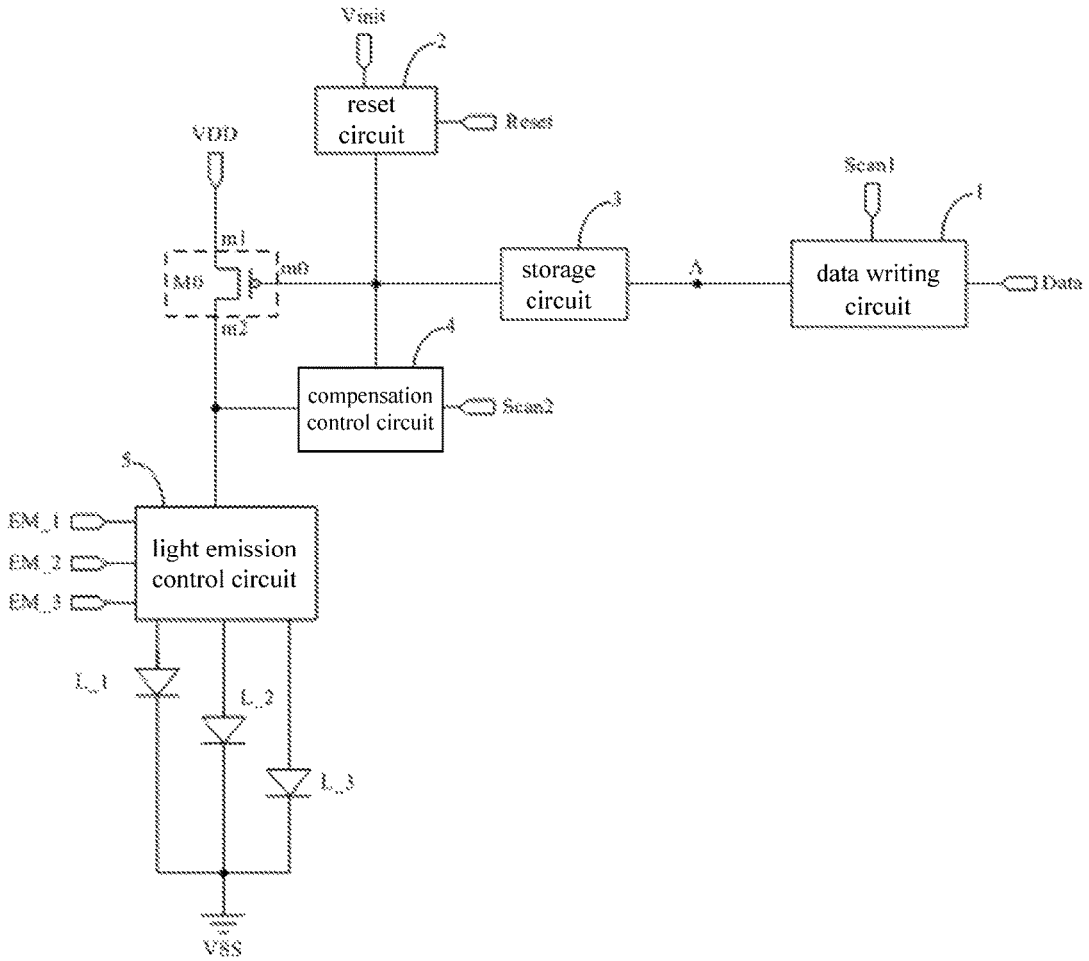
FIG. 1A is one of structural schematic diagrams of a pixel driving circuit provided by an embodiment of the present disclosure.

At least one embodiment of the present disclosure provides a pixel driving circuit, for example, which can be used for an OLED display panel. As illustrated in FIG. 1A (it is taken as an example that m=1, 2, and 3), the pixel driving circuit comprises: a data writing circuit 1, a reset circuit 2, a storage circuit 3, a compensation control circuit 4, a light emission control circuit 5, a driving transistor M0 and a plurality of light emitting devices L_m (m is an integer greater than or equal to 1).

A first electrode m1 of the driving transistor M0 is connected to a first power supply terminal VDD.

The data writing circuit 1 is respectively connected to a first scanning signal terminal Scan1, a data signal terminal Data, and a first node A; and the data writing circuit 1 is configured to time-divisionally provide a signal of the data signal terminal Data to the first node A under control of the first scanning signal terminal Scan1.

The reset circuit 2 is respectively connected to a reset signal terminal Reset, an initial signal terminal Vinit, and a control electrode m0 of the driving transistor M0; and the reset circuit 2 is configured to provide a signal of the initial signal terminal Vinit to the control electrode m0 of the driving transistor M0 under control of the reset signal terminal Reset.

The storage circuit 3 is respectively connected to the first node A and the control electrode m0 of the driving transistor M0; and the storage circuit 3 is configured to charge or discharge under control of a signal of the first node A and a signal of the control electrode m0 of the driving transistor M0, and keep the voltage difference between the first node A and the control electrode m0 of the driving transistor M0 stable when the control electrode m0 of the driving transistor M0 is in a floating state.

The compensation control circuit 4 is respectively connected to a second scanning signal terminal Scan2, the control electrode m0 of the driving transistor M0, and a second electrode m2 of the driving transistor M0; and the compensation control circuit 4 is configured to electrically conduct the control electrode m0 and the second electrode m2 of the driving transistor M0 under control of the second scanning signal terminal Scan2.

The light emission control circuit 5 is respectively connected to a light emission control signal terminal EM_m corresponding to the light emitting device L_m, the second electrode m2 of the driving transistor M0, and a first terminal of each light emitting device L_m, and a second terminal of each of the light emitting devices L_m is connected to a second power supply terminal VSS; and the light emission control circuit 5 is configured to time-divisionally electrically conduct the first terminal of the light emitting device L_m corresponding to each light emission control signal terminal EM_m and the second electrode m2 of the driving transistor M0 under control of each light emission control signal terminal EM_m to control the light emitting device L_m to emit light.

The pixel driving circuit provided by the above embodiment of the present disclosure comprises: the data writing circuit, the reset circuit, the storage circuit, the compensation control circuit, the light emission control circuit, the driving transistor and a plurality of light emitting devices. Through the cooperation of the above five circuits and the driving transistor, the pixel driving circuit can time-divisionally input the signal of the data signal terminal through the data writing circuit, and time-divisionally, electrically conduct each light emitting device and the second electrode of the driving transistor through the light emission control circuit, thereby realizing the function of controlling the plurality of light emitting devices to time-divisionally emit light, so that the structure of the pixel driving circuit can be simplified, the space for providing the pixel driving circuit can be saved, and the aperture ratio of the corresponding pixel can be increased.

Moreover, the above pixel driving circuit provided by an embodiment of the present disclosure may also enable the operation electric current of the driving transistor in the pixel driving circuit for driving the light emitting device to emit light to be relevant to the voltage of the data signal terminal only, but not relevant to the threshold voltage of the driving transistor and the voltage of the first power supply terminal, thereby avoiding the disadvantageous influence of the threshold voltage of the driving transistor and the IR drop on the operating electric current flowing through the light emitting device, so that the operating electric current for driving the light emitting device to emit light is maintained stable, and the uniformity of the luminance of the displayed image in the display panel can be improved.

Figure 1B:
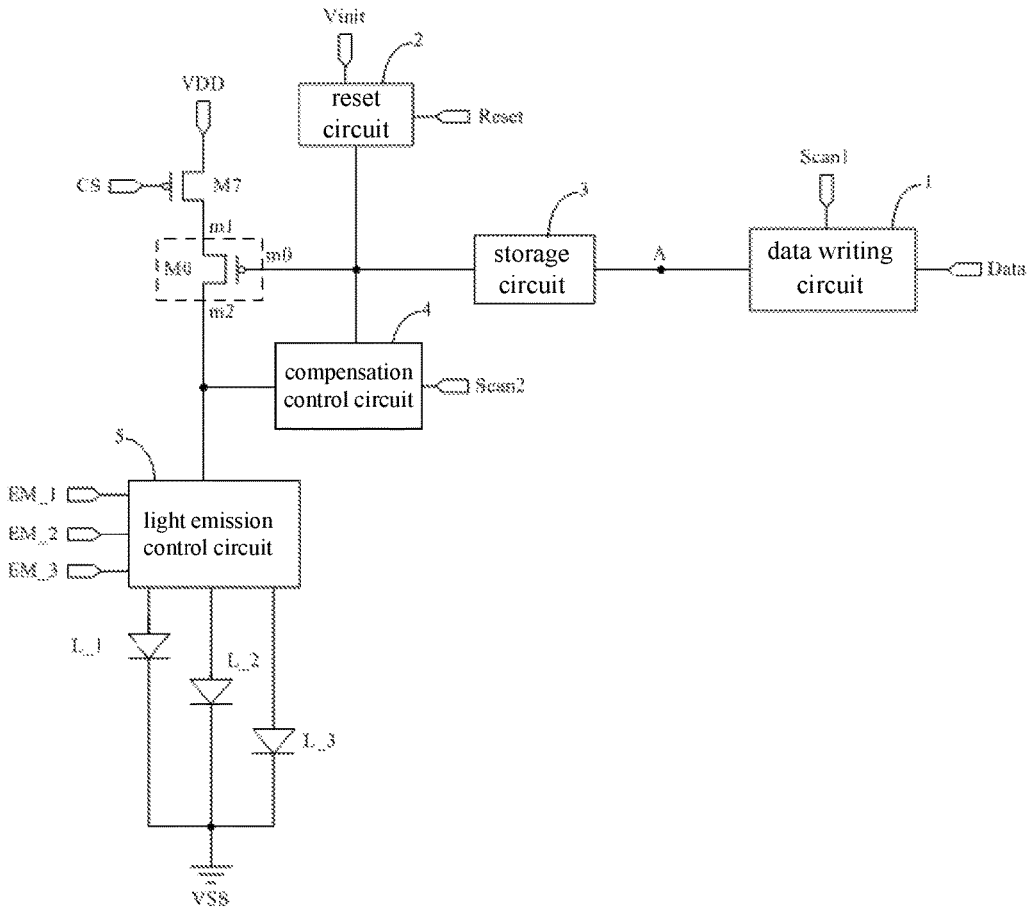
FIG. 1B is another one of structural schematic diagrams of a pixel driving circuit provided by the embodiment of the present disclosure.

In order to stably control each phase of the pixel driving circuit, in at least one example, the pixel driving circuit provided by the above embodiment of the present disclosure as illustrated in FIG. 1B may further comprise a seventh switching transistor M7; and the first power supply terminal VDD is connected to the first electrode m1 of the driving transistor M0 through the seventh switching transistor M7.

A control electrode of the seventh switching transistor M7 is connected to a writing control signal terminal CS, a first electrode of the seventh switching transistor M7 is connected to the first power supply terminal VDD, and a second electrode of the seventh switching transistor M7 is connected to the first electrode m1 of the driving transistor M0.

In at least one example, in the pixel driving circuit provided by the above embodiment of the present disclosure, as illustrated in FIG. 1B, the seventh switching transistor M7 may be a P-type switching transistor. Certainly, the seventh switching transistor M7 may also be an N-type switching transistor, and the embodiments are not limited thereto.

In at least one example, in the pixel driving circuit provided by the above embodiment of the present disclosure, when the seventh switching transistor is in turning-on state under control of the writing control signal terminal, the signal of the first power supply terminal is provided to the first electrode of the driving transistor.

In at least one example, in the pixel driving circuit provided by the above embodiment of the present disclosure, the first terminal of the light emitting device is a cathode, and the second terminal of the light emitting device is an anode. In addition, the light emitting device is generally an organic light emitting diode which achieves light emission under the effect of the electric current of the driving transistor when it is in a saturated state.

In at least one example, in the above pixel driving circuit provided by an embodiment of the present disclosure, a voltage $V_{dd}$ of the first power supply terminal generally is a positive voltage, and a voltage $V_{ss}$ of the second power supply terminal generally is grounded or a negative voltage.

In at least one example, in the pixel driving circuit provided by the above embodiment of the present disclosure, as illustrated in FIG. 1A and FIG. 1B, the driving transistor M0 is a P-type transistor; and a gate electrode of the P-type transistor is the control electrode m0 of the driving transistor M0, a source electrode of the P-type transistor is the first electrode m1 of the driving transistor M0, and a drain electrode of the P-type transistor is the second electrode m2 of the driving transistor M0. When the P-type transistor is in a saturated state, the electric current flows from the source electrode to the drain electrode of the P-type transistor. A threshold voltage $V_{th}$ of the P-type transistor generally is a negative value, and its width to length ratio is small and equivalent resistance is large.

Figure 2A:
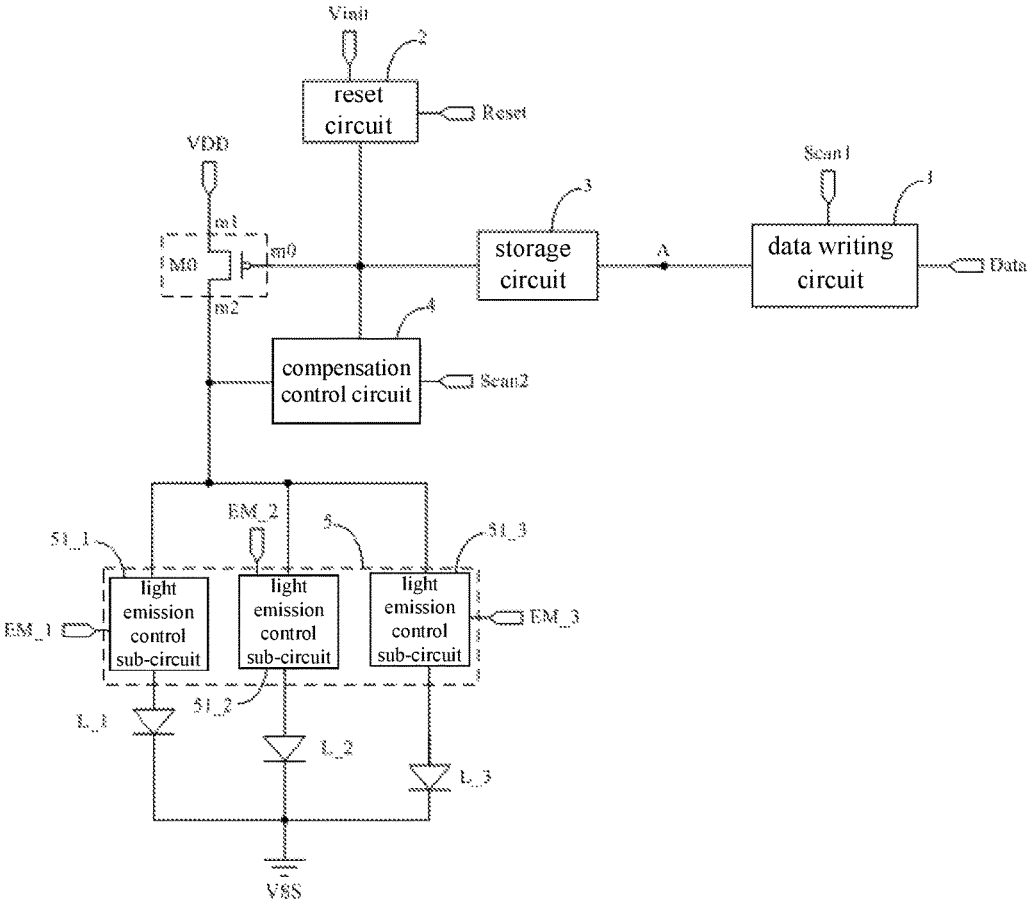
FIG. 2A is further another one of structural schematic diagrams of a pixel driving circuit provided by the embodiment of the present disclosure.
Figure 2B:
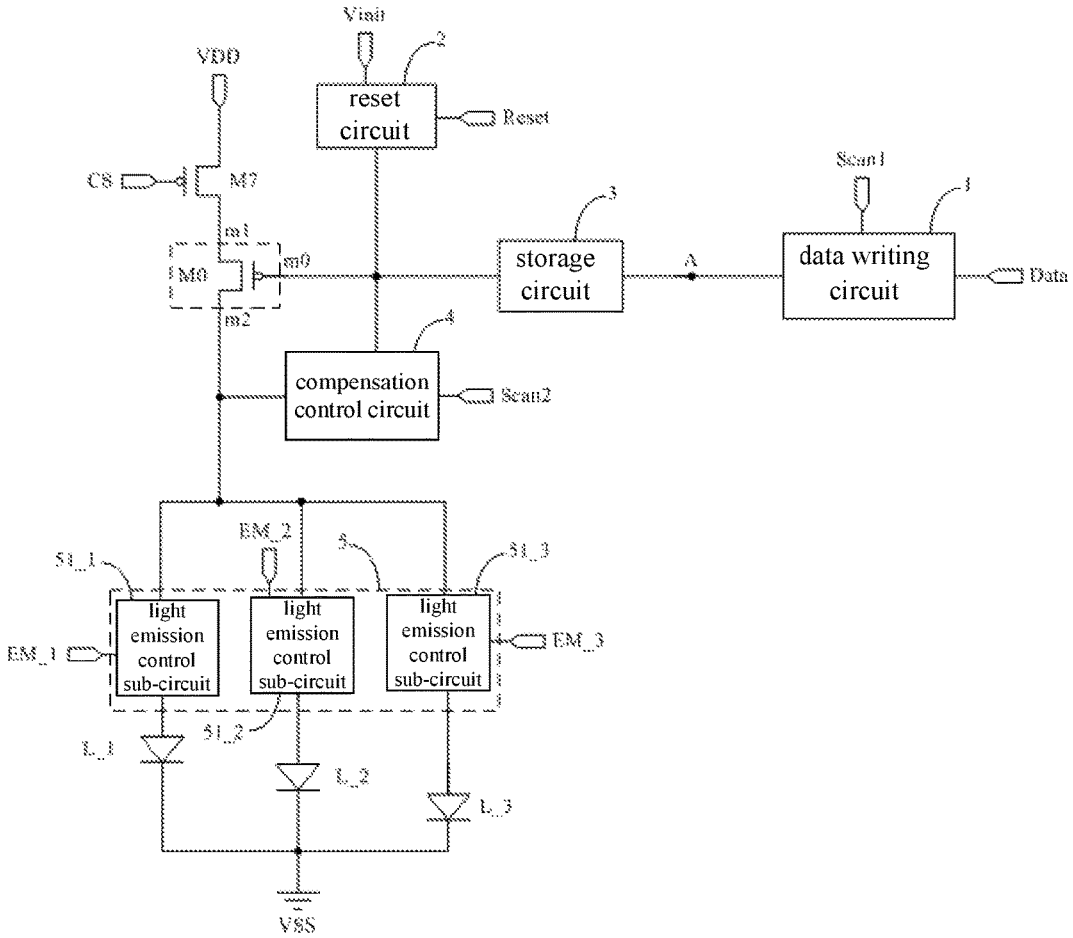
FIG. 2B is still further another one of structural schematic diagrams of a pixel driving circuit provided by the embodiment of the present disclosure.

In general, a display panel comprises a plurality of pixels, and each pixel may comprise a plurality of sub-pixels. In at least one example, in the above pixel driving circuit provided by an embodiment of the present disclosure, each light emitting device corresponds to a sub-pixel, as illustrated in FIG. 2A and FIG. 2B, and specific example of the light emission control circuit 5 may comprises: a light emission control sub-circuit 51_*m* corresponding to each light emitting device L_m.

The light emission control sub-circuit 51_*m* is respectively connected to the first terminal of the corresponding light emitting device L_m, the light emission control signal terminal EM_m corresponding to the corresponding light emitting device L_m, and the second electrode m2 of the driving transistor M0; and the light emission control sub-circuit 51_*m* is used to electrically conduct the second electrode m2 of the driving transistor M0 and the first terminal of the connected light emitting device L_m under control of the connected light emission control signal terminal EM_m.

In at least one example, in the above pixel driving circuit provided by an embodiment of the present disclosure, each light emitting device corresponds to a sub-pixel. These sub-pixels may be adjacent sub-pixels in a same column, so that the data signal can be input to the data signal terminal through one data line, which can simplify the wiring process and reduce occupied space. Of course, these sub-pixels may also be f sub-pixels in different columns. The arrangement of these sub-pixels needs to be determined according to the actual application environment, and is not limited herein.

A display panel generally adopts the colors of three sub-pixels of red, green, and blue sub-pixels to synthesize the color of one pixel, so as to realize color display. In at least one example, in the above pixel driving circuit provided by an embodiment of the present disclosure, as illustrated in FIG. 2A and FIG. 2B, the pixel driving circuit may specifically comprise: a red light emitting device L_1, a green light emitting device L_2, and a blue light emitting device L_3.

The light emission control circuit 5 comprises: a red light emission control sub-circuit 51_1, a green light emission control sub-circuit 51_2, and a blue light emission control sub-circuit 51_3.

The red light emission control sub-circuit 51_1 is respectively connected to a first terminal of the red light emitting device L_1, a red light emission control signal terminal EM_1 corresponding to the red light emitting device L_1, and the second electrode m2 of the driving transistor M0; and the red light emission control sub-circuit 51_1 is used to electrically conduct the first terminal of the red light emitting device L_1 and the second electrode m2 of the driving transistor M0 under control of the red light emission control signal terminal EM_1.

The green light emission control sub-circuit 51_2 is respectively connected to a first terminal of the green light emitting device L_2, a green light emission control signal terminal EM_2 corresponding to the green light emitting device L_2, and the second electrode m2 of the driving transistor M0; and the green light emission control sub-circuit 51_2 is used to electrically conduct the first terminal of the green light emitting device L_2 and the second electrode m2 of the driving transistor M0 under control of the green light emission control signal terminal EM_2; and The blue light emission control sub-circuit 51_3 is respectively connected to a first terminal of the blue light emitting device L_3, a blue light emission control signal terminal EM_3 corresponding to the blue light emitting device L_3, and the second electrode m2 of the driving transistor M0; and the blue light emission control sub-circuit 51_3 is used to electrically conduct the first terminal of the blue light emitting device L_3 and the second electrode m2 of the driving transistor M0 under control of the blue light emission control signal terminal EM_3.

The embodiments of the present disclosure are described in detail below with reference to the specific examples. It should be noted that these examples are for better explaining the embodiments of the present disclosure, but do not limit the embodiments of the present disclosure.

In at least one example, in the above pixel driving circuit provided by an embodiment of the present disclosure, as illustrated in FIG. 3A to FIG. 4B, the red light emission control sub-circuit 51_1 may specifically comprise a first switching transistor M1.

A control electrode of the first switching transistor M1 is connected to the red light emission control signal terminal EM_1, a first electrode of the first switching transistor M1 is connected to the second electrode m2 of the driving transistor M0, and a second electrode of the first switching transistor M1 is connected to the first terminal of the red light emitting device L_1.

Figure 3A:
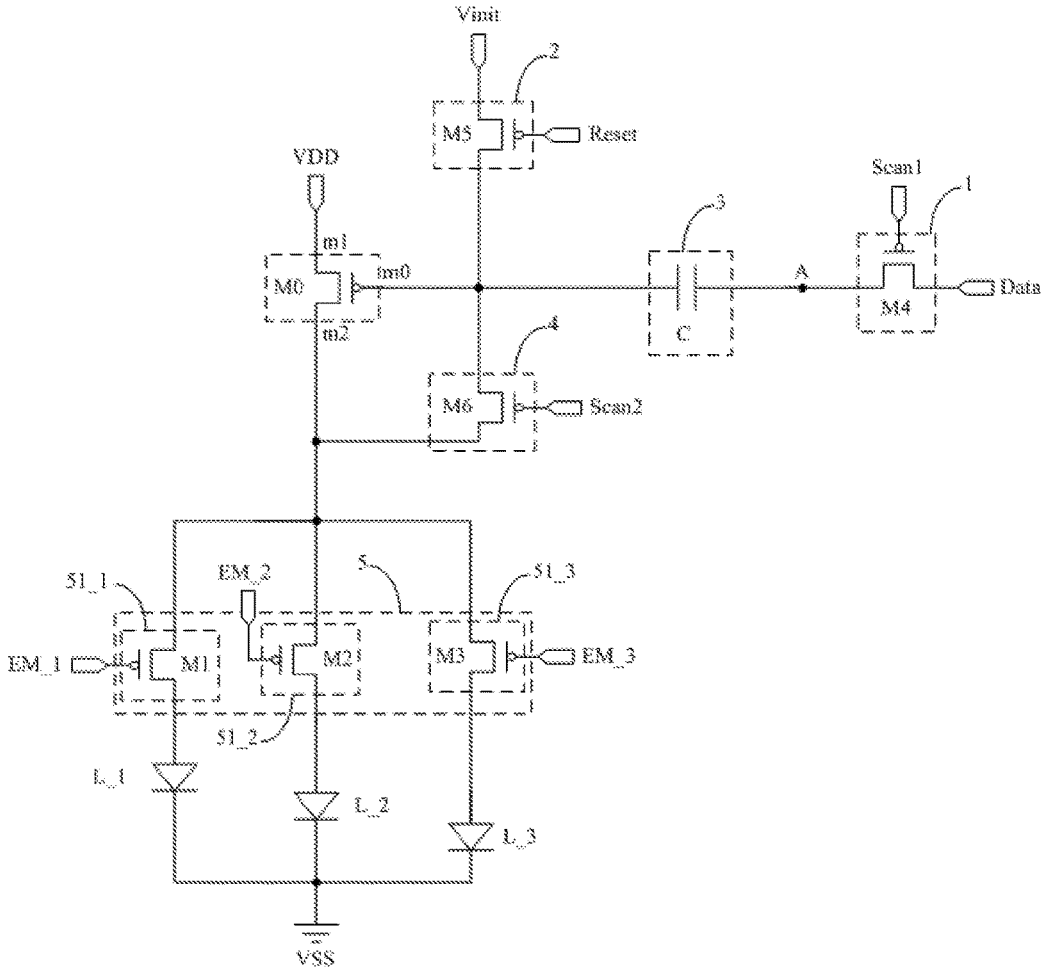
FIG. 3A is one of specific structural schematic diagrams of the pixel driving circuit as illustrated in FIG. 2A.
Figure 3B:
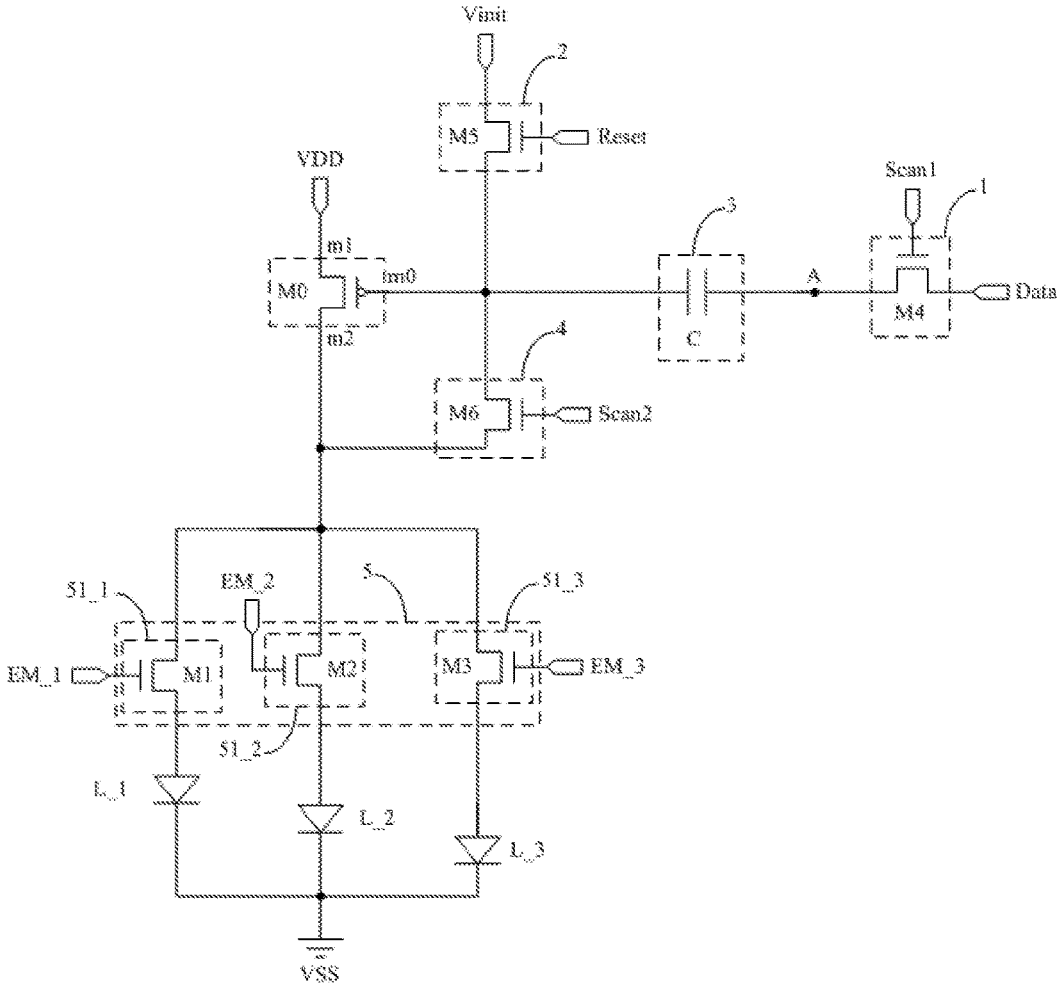
FIG. 3B is another one of specific structural schematic diagrams of the pixel driving circuit as illustrated in FIG. 2A.
Figure 4A:
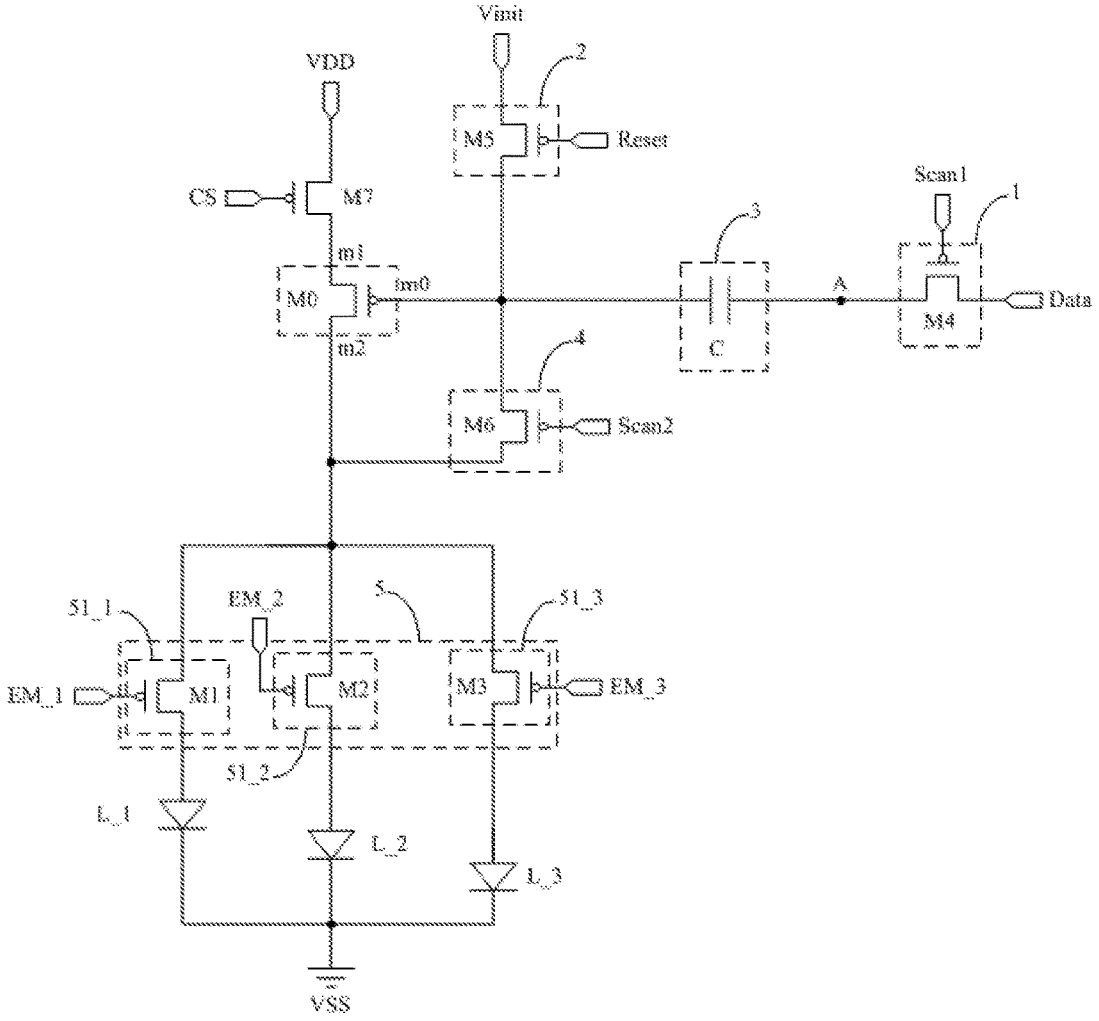
FIG. 4A is one of specific structural schematic diagrams of the pixel driving circuit as illustrated in FIG. 2B.
Figure 4B:
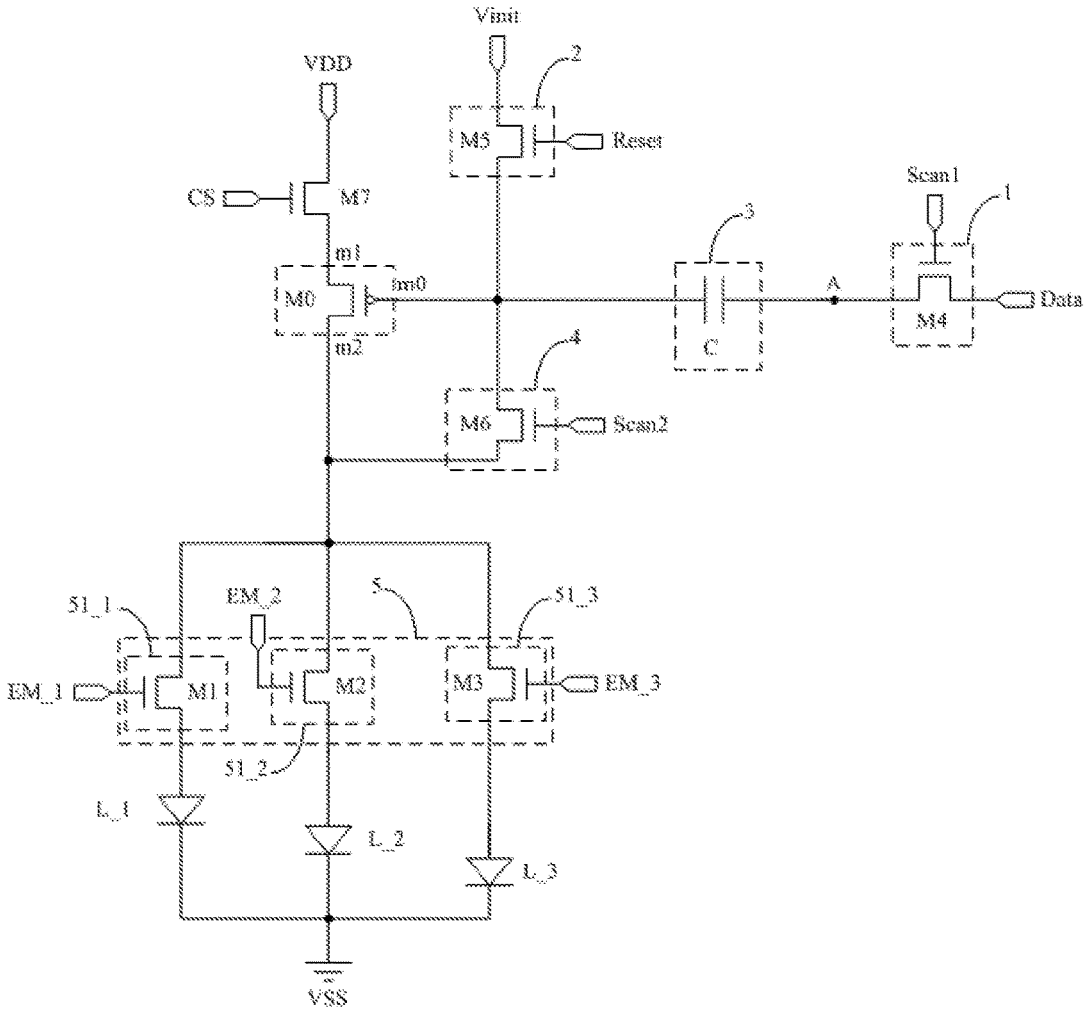
FIG. 4B is another one of specific structural schematic diagrams of the pixel driving circuit as illustrated in FIG. 2B.

In at least one example, in the above pixel driving circuit provided by an embodiment of the present disclosure, as illustrated in FIG. 3A and FIG. 4A, the first switching transistor M1 may be a P-type switching transistor. Or as illustrated in FIG. 3B and FIG. 4B, the first switching transistor M1 may also be an N-type switching transistor. In actual application, the type of the first switching transistor needs to be determined according to the actual application environment, and is not limited herein.

In the specific implementation, in the above pixel driving circuit provided by embodiments of the present disclosure, when the first switching transistor is in turning-on state under control of the red light emission control signal terminal, the signal of the second electrode of the driving transistor is provided to the first terminal of the red light emitting device, so as to drive the red light emitting device to emit light.

In at least one example, in the above pixel driving circuit provided by embodiments of the present disclosure, as illustrated in FIG. 3A to FIG. 4B, the green light emission control sub-circuit 51_2 may specifically comprise a second switching transistor M2.

A control electrode of the second switching transistor M2 is connected to the green light emission control signal terminal EM_2, a first electrode of the second switching transistor M2 is connected to the second electrode m2 of the driving transistor M0, and a second electrode of the second switching transistor M2 is connected to the first terminal of the green light emitting device L_2.

In at least one example, in the above pixel driving circuit provided by embodiments of the present disclosure, as illustrated in FIG. 3A and FIG. 4A, the second switching transistor M2 may be a P-type switching transistor. Or as illustrated in FIG. 3B and FIG. 4B, the second switching transistor M2 may also be an N-type switching transistor. In actual application, the type of the second switching transistor needs to be determined according to the actual application environment, and is not limited herein.

In at least one example, in the above pixel driving circuit provided by an embodiment of the present disclosure, when the second switching transistor is in turning-on state under control of the green light emission control signal terminal, the signal of the second electrode of the driving transistor is provided to the first terminal of the green light emitting device, so as to drive the green light emitting device to emit light.

In at least one example, in the above pixel driving circuit provided by embodiments of the present disclosure, as illustrated in FIG. 3A to FIG. 4B, the blue light emission control sub-circuit 51_3 may specifically comprise a third switching transistor M3.

A control electrode of the third switching transistor M3 is connected to the blue light emission control signal terminal EM_3, a first electrode of the third switching transistor M3 is connected to the second electrode m2 of the driving transistor M0, and a second electrode of the third switching transistor M3 is connected to the first terminal of the blue light emitting device L_3.

In at least one example, in the above pixel driving circuit provided by embodiments of the present disclosure, as illustrated in FIG. 3A and FIG. 4A, the third switching transistor M3 may be a P-type switching transistor. Or as illustrated in FIG. 3B and FIG. 4B, the third switching transistor M3 may also be an N-type switching transistor. In actual application, the type of the third switching transistor needs to be determined according to the actual application environment, and is not limited herein.

In at least one example, in the above pixel driving circuit provided by an embodiment of the present disclosure, when the third switching transistor is in turning-on state under control of the blue light emission control signal terminal, the signal of the second electrode of the driving transistor is provided to the first terminal of the blue light emitting device, so as to drive the blue light emitting device to emit light.

In at least one example, in the above pixel driving circuit provided by an embodiment of the present disclosure, as illustrated in FIG. 3A to FIG. 4B, the data writing circuit 1 may specifically comprise a fourth switching transistor M4.

A control electrode of the fourth switching transistor M4 is connected to the first scanning signal terminal Scant, a first electrode of the fourth switching transistor M4 is connected to the data signal terminal Data, and a second electrode of the fourth switching transistor M4 is connected to the first node A.

In at least one example, in the above pixel driving circuit provided by an embodiment of the present disclosure, as illustrated in FIG. 3A and FIG. 4A, the fourth switching transistor M4 may be a P-type switching transistor. Or as illustrated in FIG. 3B and FIG. 4B, the fourth switching transistor M4 may also be an N-type switching transistor. In actual application, the type of the fourth switching transistor needs to be determined according to the actual application environment, and is not limited herein.

In at least one example, in the above pixel driving circuit provided by embodiments of the present disclosure, when the fourth switching transistor is in turning-on state under control of the first scanning signal terminal, the signal of the data signal terminal is time-divisionally provided to the first node.

In at least one example, in the above pixel driving circuit provided by embodiments of the present disclosure, as illustrated in FIG. 3A to FIG. 4B, the reset circuit 2 may specifically comprise a fifth switching transistor M5.

A control electrode of the fifth switching transistor M5 is connected to the reset signal terminal Reset, a first electrode of the fifth switching transistor M5 is connected to the initial signal terminal Vinit, and a second electrode of the fifth switching transistor M5 is connected to the control electrode m0 of the driving transistor M0.

In at least one example, in the above pixel driving circuit provided by an embodiment of the present disclosure, as illustrated in FIG. 3A and FIG. 4A, the fifth switching transistor M5 may be a P-type switching transistor. Or as illustrated in FIG. 3B and FIG. 4B, the fifth switching transistor M5 may also be an N-type switching transistor. In actual application, the type of the fifth switching transistor needs to be determined according to the actual application environment, and is not limited herein.

In at least one example, in the above pixel driving circuit provided by an embodiment of the present disclosure, when the fifth switching transistor is in turning-on state under control of the reset signal terminal, the signal of the initial signal terminal is provided to the control electrode of the driving transistor.

In at least one example, in the above pixel driving circuit provided by an embodiment of the present disclosure, as illustrated in FIG. 3A to FIG. 4B, the compensation control circuit 4 may specifically comprise a sixth switching transistor M6.

A control electrode of the sixth switching transistor M6 is connected to the second scanning signal terminal Scan2, a first electrode of the sixth switching transistor M6 is connected to the control electrode m0 of the driving transistor M0, and a second electrode of the sixth switching transistor M6 is connected to the second electrode m2 of the driving transistor M0.

In at least one example, in the above pixel driving circuit provided by an embodiment of the present disclosure, as illustrated in FIG. 3A and FIG. 4A, the sixth switching transistor M6 may be a P-type switching transistor. Or as illustrated in FIG. 3B and FIG. 4B, the sixth switching transistor M6 may also be an N-type switching transistor. In actual application, the type of the sixth switching transistor needs to be determined according to the actual application environment, and is not limited herein.

In at least one example, in the above pixel driving circuit provided by an embodiment of the present disclosure, when the sixth switching transistor is in turning-on state under control of the second scanning signal terminal, the control electrode and the second electrode of the driving transistor are electrically conducted to make the driving transistor in state of diode connection, so as to store the threshold voltage $V_{th}$ of the driving transistor and the voltage $V_{dd}$ of the first power supply terminal in the control electrode of the driving transistor.

In at least one example, in the above pixel driving circuit provided by embodiments of the present disclosure, as illustrated in FIG. 3A to FIG. 4B, the storage circuit 3 may specifically comprise a capacitor C; and the capacitor C is connected between the first node A and the control electrode m0 of the driving transistor M0.

In at least one example, in the above pixel driving circuit provided by an embodiment of the present disclosure, the capacitor charges under control of the signal of the first node and the signal of the control electrode of the driving transistor, discharges under control of the signal of the first node and the signal of the control electrode of the driving transistor, and keeps the voltage difference between the first node and the control electrode of the driving transistor stable when the control electrode of the driving transistor is in the floating state.

The above are merely examples to illustrate the specific structures of the red light emission control sub-circuit, the green light emission control sub-circuit, the blue light emission control sub-circuit, the data writing circuit, the reset circuit, the storage circuit, the compensation control circuit and the voltage writing circuit in the pixel driving circuit provided by an embodiment of the present disclosure. The specific structures of the above circuits are not limited to the above structures provided by the embodiment of the present disclosure, and may also be other structures known by those skilled in the art, which are not limited herein.

Further, in order to simplify the production process of the pixel driving circuit, in at least one example, in the above pixel driving circuit provided by an embodiment of the present disclosure, as illustrated in FIG. 3A and FIG. 4A, when the driving transistor M0 is a P-type transistor, all the switching transistors may be P-type switching transistors.

In at least one example, in the above pixel driving circuit provided by an embodiment of the present disclosure, the P-type switching transistor turns off under control of a high potential and turns on under control of a low potential, and the N-type switching transistor turns on under control of a high potential and turns off under control of a low potential.

In the above pixel driving circuit provided by an embodiment of the present disclosure, it should be noted that the driving transistor and the switching transistor may be thin film transistors (TFTs) or metal oxide semiconductors (MOSs), which are not limited herein. In the specific implementation, the control electrode of the switching transistor is used as the gate electrode of the switching transistor. These switch transistors may use the first electrode as the source electrode or the drain electrode of the switching transistors and use the second electrode as the drain electrode or the source electrode of the switching transistors, according to the type of the transistors and the signals applied from the signal terminals, which is not limited herein. And in the description of the specific embodiments, it is illustrated as an example that the driving transistor and the switching transistor are thin film transistors.

The working process of the above pixel driving circuits provided by an embodiment of the present disclosure is described below in combination with the circuit timing diagram and the pixel driving circuit illustrated in FIG. 3A and FIG. 4A is taken as an example. In the following description, "1" represents a high potential and "0" represents a low potential. Here it should be noted that 1 and 0 are logic potentials, which are only used to better explain the specific working process of the embodiments of the present disclosure, rather than the actual potentials applied to the control electrode of each switching transistor in the specific implementation.

First Embodiment

Figure 5A:
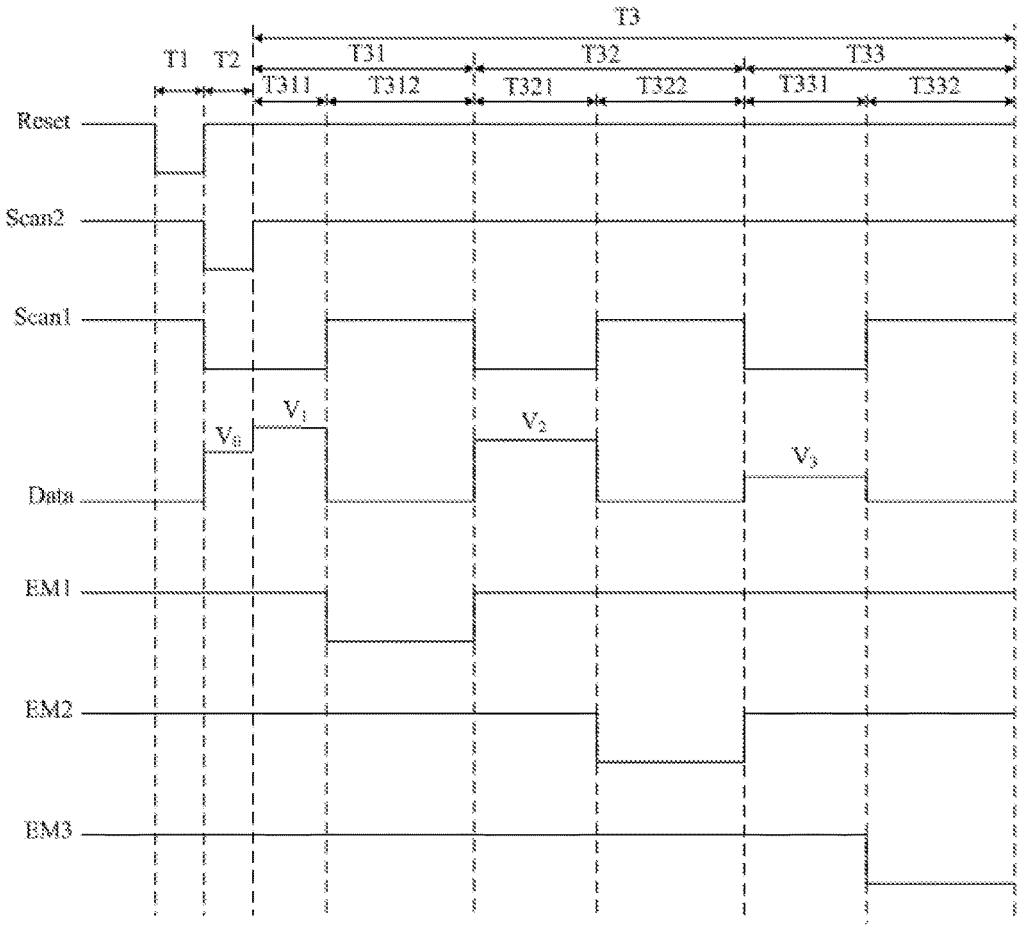
FIG. 5A is a timing diagram of the pixel driving circuit as illustrated in FIG. 3A.

As illustrated in FIG. 3A, the driving transistor M0 is a P-type transistor, and all the switching transistors are P-type transistors. The corresponding circuit timing diagram is illustrated in FIG. 5A. Three phases, that is, a first phase T1, a second phase T2 and a third phase T3 in the input timing diagram as illustrated in FIG. 5A are selected, and the third phase T3 comprises a light emitting phase T31, a light emitting phase T32, and a light emitting phase T33. The light emitting phase T31 has two phases: a data writing bootstrap sub-phase T311 and a light emitting sub-phase T312, the light emitting phase T32 has two phases: a data writing bootstrap sub-phase T321 and a light emitting sub-phase T322, and the light emitting phase T33 has two phases: a data writing bootstrap sub-phase T331 and a light emitting sub-phase T332.

In the first phase T1, Reset=0, Scan1=1, Scan2=1, EM1=1, EM2=1 and EM3=1.

The fifth switching transistor M5 turns on due to Reset=0. The fourth switching transistor M4 turns off due to Scan1=1. The sixth switching transistor M6 turns off due to Scan2=1. The first switching transistor M1 turns off due to EM1=1. The second switching transistor M2 turns off due to EM2=1.

The third switching transistor M3 turns off due to EM3=1. The turning-on fifth switching transistor M5 provides the signal of the initial signal terminal Vinit to the gate electrode of the driving transistor M0, so as to reset the gate electrode of the driving transistor M0 and discharge the gate electrode of the driving transistor M0 to the potential of the signal of the initial signal terminal Vinit, resetting the previous voltage signal.

In the second phase T2, Reset=1, Scan1=0, Scan2=0, EM1=1, EM2=1 and EM3=1.

The fourth switching transistor M4 turns on due to Scan1=0. The sixth switching transistor M6 turns on due to Scan2=0. The fifth switching transistor M5 turns off due to Reset=1. The first switching transistor M1 turns off due to EM1=1. The second switching transistor M2 turns off due to EM2=1. The third switching transistor M3 turns off due to EM3=1. The turning-on fourth switching transistor M4 provides an initial data signal $V_o$ of the data signal terminal Data to the first node A. Therefore, the voltage of the first node A is $V_o$, i.e., the voltage of one terminal of the storage capacitor C is $V_o$, so as to store the initial data signal. The turning-on sixth switching transistor M6 electrically conducts the gate electrode and the drain electrode of the driving transistor M0 to make the driving transistor M0 in the state of diode connection. Because the driving transistor M0 which is in the state of diode connection and the turning-on sixth switching transistor M6 can make the first power supply terminal VDD to charge the capacitor C until the voltage of the gate electrode of the driving transistor M0 changes to $V_{dd}+V_{th}$, i.e., the voltage of the other terminal of the capacitor C is $V_{dd}+V_{th}$, the threshold voltage $V_{th}$ of the driving transistor is stored and the voltage difference between the two terminals of the capacitor C is $V_{dd}+V_{th}-V_o$ at present.

In the third phase T3, in the data writing bootstrap sub-phase T311 of the light emitting phase T31, Reset=1, Scan1=0, Scan2=1, EM1=1, EM2=1 and EM3=1.

The fourth switching transistor M4 turns on due to Scan1=0. The sixth switching transistor M6 turns off due to Scan2=1. The fifth switching transistor M5 turns off due to Reset=1. The first switching transistor M1 turns off due to EM1=1. The second switching transistor M2 turns off due to EM2=1. The third switching transistor M3 turns off due to EM3=1. The turning-on fourth switching transistor M4 provides the first light emitting data signal $V_1$ of the data signal terminal Data to the first node A. Therefore, the voltage of the first node A is $V_1$, i.e., the voltage of one terminal of the capacitor C is $V_1$, so as to store the first light emitting data signal. Because both the fifth switching transistor M5 and the sixth switching transistor M6 turn off, the gate electrode of the driving transistor M0 is in the floating state, i.e., the other terminal of the capacitor C is in the floating state. According to the law of charge conservation for the charge of the capacitor C before and after the jump, in order to maintain the voltage difference between the two terminals of the capacitor C to be still $V_{dd}+V_{th}-V_o$, the voltage of the other terminal of the capacitor C jumps to $V_{dd}+V_{th}-V_o+V_1$, i.e., the voltage of the gate electrode of the driving transistor M0 is $V_{dd}+V_{th}-V_o+V_1$.

In the light emitting sub-phase T312, Reset=1, Scan1=1, Scan2=1, EM1=0, EM2=1 and EM3=1.

The first switching transistor M1 turns on due to EM1=0. The fourth switching transistor M4 turns off due to Scan1=1. The sixth switching transistor M6 turns off due to Scan2=1. The fifth switching transistor M5 turns off due to Reset=1. The second switching transistor M2 turns off due to EM2=1. The third switching transistor M3 turns off due to EM3=1. The voltage of the source electrode of the driving transistor M0 is $V_{dd}$, and the voltage of the gate electrode of the driving transistor M0 is $V_{dd}+V_{th}-V_o+V_1$, which comprises the initial data signal $V_o$, the first light emitting data signal $V_1$ and the threshold voltage $V_{th}$ of the driving transistor, and is based on the above three parameters. At present, the driving transistor M0 is in a saturation state. According to the electric current characteristics of the saturation state, the operating electric current which flows through the driving transistor M0 and is used to drive the red light emitting device $I_{L_1}$ to emit light meets formula:

$$I_{L_1}=K(V_{gs}-V_{th})^2=K[(V_{dd}+V_{th}-V_o+V_1-V_{dd})-V_{th}]^2=K(V_1-V_o)^2,$$

wherein $V_{gs}$ is the voltage between the gate electrode and the source electrode of the driving transistor M0; and K is a structure parameter and this value is relatively stable in the same structure and therefore can be regarded as a constant. Therefore, the red light emitting device L_1 begins to emit light. And it can be known from the above formula that the electric current of the driving transistor M0 when it is in the saturation state is only relevant to the voltage $V_o$ and $V_1$ of the data signal terminal Data, and is not relevant to the threshold voltage $V_{th}$ of the driving transistor M0 and the voltage $V_{dd}$ of the first power supply terminal VDD. The problem that the threshold voltage $V_{th}$ drifts due to the formation process of the driving transistor M0 and the long-time operation can be solved, and the influence of the IR drop on the driving electric current flowing through the red light emitting device L_1 can be avoided, so that the operating electric current of the red light emitting device L_1 can be kept stable to achieve light emission stability.

In the data writing bootstrap sub-phase T321 of the light emitting phase T32, Reset=1, Scan1=0, Scan2=1, EM1=1, EM2=1 and EM3=1.

The fourth switching transistor M4 turns on due to Scan1=0. The sixth switching transistor M6 turns off due to Scan2=1. The fifth switching transistor M5 turns off due to Reset=1. The first switching transistor M1 turns off due to EM1=1. The second switching transistor M2 turns off due to EM2=1. The third switching transistor M3 turns off due to EM3=1. The turning-on fourth switching transistor M4 provides a second light emitting data signal $V_2$ of the data signal terminal Data to the first node A. Therefore, the voltage of the first node A is $V_2$, i.e., the voltage of one terminal of the capacitor C is $V_2$, so as to store the second light emitting data signal. Because both the fifth switching transistor M5 and the sixth switching transistor M6 turn off, the gate electrode of the driving transistor M0 is in the floating state, i.e., the other terminal of the capacitor C is in the floating state. According to the law of charge conservation for the charge of the capacitor C before and after the jump, in order to maintain the voltage difference between the two terminals of the capacitor C to be still $V_{dd}+V_{th}-V_o$, the voltage of the other terminal of the capacitor C jumps to $V_{dd}+V_{th}-V_o+V_2$, i.e., the voltage of the gate electrode of the driving transistor M0 is $V_{dd}+V_{th}-V_o+V_2$.

In the light emitting sub-phase T322, Reset=1, Scan1=1, Scan2=1, EM1=1, EM2=0 and EM3=1.

The second switching transistor M2 turns on due to EM2=0. The fourth switching transistor M4 turns off due to Scan1=1. The sixth switching transistor M6 turns off due to Scan2=1. The fifth switching transistor M5 turns off due to Reset=1. The first switching transistor M1 turns off due to EM1=1. The third switching transistor M3 turns off due to EM3=1. The voltage of the source electrode of the driving transistor M0 is $V_{dd}$, and the voltage of the gate electrode of the driving transistor M0 is $V_{dd}+V_{th}-V_o+V_2$. At present, the driving transistor M0 is in the saturation state. According to the electric current characteristics of the saturation state, the operating electric current $I_{L_2}$ which flows through the driving transistor M0 and is used to drive the green light emitting device L_2 to emit light meets formula:

$$I_{L_2}=K(V_{gs}-V_{th})^2=K[(V_{dd}+V_{th}-V_o+V_2-V_{dd})-V_{th}]^2=K(V_2-V_o)^2,$$

wherein $V_{gs}$ is the voltage between the gate electrode and the source electrode of the driving transistor M0; and K is a structure parameter and this value is relatively stable in the same structure and therefore can be counted as a constant. Therefore, the green light emitting device L_2 begins to emit light. And it could be known from the above formula that the electric current of the driving transistor M0 when it is in the saturation state is only relevant to the voltage $V_o$ and $V_2$ of the data signal terminal Data, and is not relevant to the threshold voltage $V_{th}$ of the driving transistor M0 and the voltage $V_{dd}$ of the first power supply terminal VDD. The problem that the threshold voltage $V_{th}$ drifts due to the process of the driving transistor M0 and the long-time operation can be solved, and the influence of the IR drop on the driving electric current flowing through the green light emitting device L_2 can be avoided, so that the operating electric current of the green light emitting device L_2 can be kept stable to achieve light emission stability.

In the data writing bootstrap sub-phase T331 of the light emitting phase T33, Reset=1, Scan1=0, Scan2=1, EM1=1, EM2=1 and EM3=1.

The fourth switching transistor M4 turns on due to Scan1=0. The sixth switching transistor M6 turns off due to Scan2=1. The fifth switching transistor M5 turns off due to Reset=1. The first switching transistor M1 turns off due to EM1=1. The second switching transistor M2 turns off due to EM2=1. The third switching transistor M3 turns off due to EM3=1. The turning-on fourth switching transistor M4 provides a third light emitting data signal $V_3$ of the data signal terminal Data to the first node A. Therefore, the voltage of the first node A is $V_3$, i.e., the voltage of one terminal of the capacitor C is $V_3$, so as to store the third light emitting data signal. Because both the fifth switching transistor M5 and the sixth switching transistor M6 turn off, the gate electrode of the driving transistor M0 is in the floating state, i.e., the other terminal of the capacitor C is in the floating state. According to the law of charge conservation for the charge of the capacitor C before and after the jump, in order to maintain the voltage difference between the two terminals of the capacitor C to be still $V_{dd}+V_{th}-V_o$, the voltage of the other terminal of the capacitor C jumps to $V_{dd}+V_{th}-V_o+V_3$, i.e., the voltage of the gate electrode of the driving transistor M0 is $V_{dd}+V_{th}-V_o+V_3$.

In the light emitting sub-phase T332, Reset=1, Scan1=1, Scan2=1, EM1=1, EM2=1 and EM3=0.

The third switching transistor M3 turns on due to EM3=0. The fourth switching transistor M4 turns off due to Scan1=1. The sixth switching transistor M6 turns off due to Scan2=1. The fifth switching transistor M5 turns off due to Reset=1. The first switching transistor M1 turns off due to EM1=1. The second switching transistor M2 turns off due to EM2=1. The voltage of the source electrode of the driving transistor M0 is $V_{dd}$, and the voltage of the gate electrode of the driving transistor M0 is $V_{dd}+V_{th}-V_o+V_3$. At present, the driving transistor M0 is in the saturation state. According to the electric current characteristics of the saturation state, the operating electric current $I_{L_3}$ which flows through the driving transistor M0 and is used to drive the blue light emitting device L_3 to emit light meets formula:

$$I_{L_3}=K(V_{gs}-V_{th})^2=K[(V_{dd}+V_{th}-V_o+V_3-V_{dd})-V_{th}]^2=K(V_3-V_o)^2,$$

wherein $V_{gs}$ is the voltage between the gate electrode and the source electrode of the driving transistor M0; and K is a structure parameter and this value is relatively stable in the same structure therefore can be counted as a constant. Therefore, the blue light emitting device L_3 begins to emit light. And it could be known from the above formula that the electric current of the driving transistor M0 when it is in the saturation state is only relevant to the voltage $V_o$ and $V_3$ of the data signal terminal Data, and is not relevant to the threshold voltage $V_{th}$ of the driving transistor M0 and the voltage $V_{dd}$ of the first power supply terminal VDD. The problem that the threshold voltage $V_{th}$ drift due to the process of the driving transistor M0 and the long-time operation can be solved, and the influence of the IR drop on the driving electric current flowing through the blue light emitting device L_3 can be avoided, so that the operating electric current of the blue light emitting device L_3 can be kept stable to achieve light emission stability.

Second Embodiment

Figure 5B:
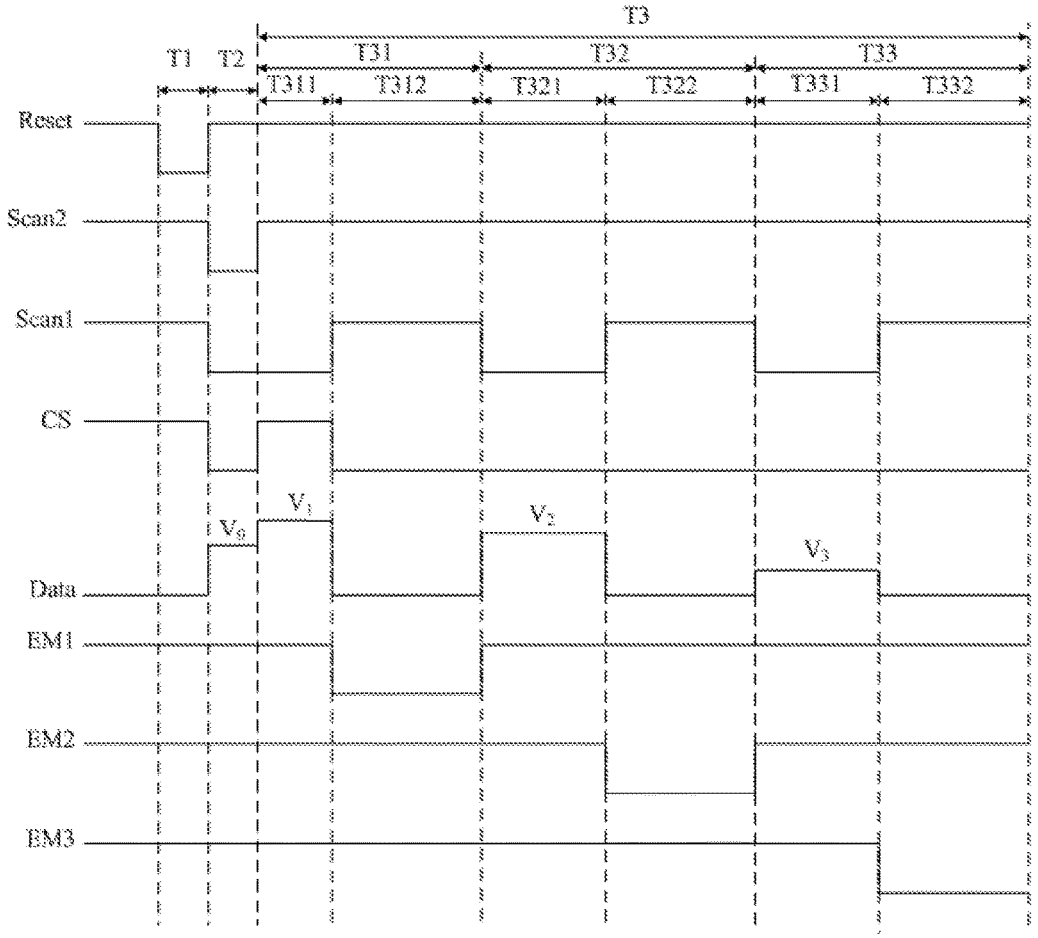
FIG. 5B is a timing diagram of the pixel driving circuit as illustrated in FIG. 4A.

As illustrated in FIG. 4A, the driving transistor M0 is a P-type transistor, and all the switching transistors are P-type transistors. The corresponding circuit timing diagram is illustrated in FIG. 5B. Three phases that is, a first phase T1, a second phase T2 and a third phase T3 in the input timing diagram as illustrated in FIG. 5B are selected, and the third phase T3 comprises a light emitting phase T31, a light emitting phase T32 and a light emitting phase T33. The light emitting phase T31 has two phases: a data writing bootstrap sub-phase T311 and a light emitting sub-phase T312, the light emitting phase T32 has two phases: a data writing bootstrap sub-phase T321 and a light emitting sub-phase T322, and the light emitting phase T33 has two phases: a data writing bootstrap sub-phase T331 and a light emitting sub-phase T332.

In the first phase T1, Reset=0, Scan1=1, Scan2=1, CS=1, EM1=1, EM2=1 and EM3=1. The seventh switching transistor M7 turns off due to CS=1. The specific working process is basically the same as the working process in the first phase T1 in the first embodiment, and will not be repeated here.

In the second phase T2, Reset=1, Scan1=0, Scan2=0, CS=0, EM1=1, EM2=1 and EM3=1. The seventh switching transistor M7 turns on due to CS=0. The turning-on seventh switching transistor M7 can electrically conduct the first power supply terminal VDD and the first electrode of the driving transistor M0. The specific working process is basically the same as the working process in the second phase T2 in the first embodiment, and will not be repeated here.

In the third phase T3, in the data writing bootstrap sub-phase T311 of the light emitting phase T31, Reset=1, Scan1=0, Scan2=1, CS=1, EM1=1, EM2=1 and EM3=1. The seventh switching transistor M7 turns off due to CS=1. The specific working process is basically the same as the working process in T311 in the third phase in the first embodiment, and will not be repeated here.

In the light emitting sub-phase T312, Reset=1, Scan1=1, Scan2=1, CS=0, EM1=0, EM2=1 and EM3=1. The seventh switching transistor M7 turns on due to CS=0. The turning-on seventh switching transistor M7 can electrically conduct the first power supply terminal VDD and the first electrode of the driving transistor M0. The specific working process is basically the same as the working process in T312 in the third phase in the first embodiment and the red light emitting device L_1 begins to emit light, which will not be repeated here.

In the data writing bootstrap sub-phase T321 of the light emitting phase T32, Reset=1, Scan1=0, Scan2=1, CS=0, EM1=1, EM2=1 and EM3=1. The seventh switching transistor M7 turns on due to CS=0. The turning-on seventh switching transistor M7 can electrically conduct the first power supply terminal VDD and the first electrode of the driving transistor M0. The specific working process is basically the same as the working process in T321 in the third phase in the first embodiment, and will not be repeated here.

In the light emitting sub-phase T322, Reset=1, Scan1=1, Scan2=1, CS=0, EM1=1, EM2=0 and EM3=1. The seventh switching transistor M7 turns on due to CS=0. The turning-on seventh switching transistor M7 can electrically conduct the first power supply terminal VDD and the first electrode of the driving transistor M0. The specific working process is basically the same as the working process in T322 in the third phase in the first embodiment and the green light emitting device L_2 begins to emit light, which will not be repeated here.

In the data writing bootstrap sub-phase T331 of the light emitting phase T33, Reset=1, Scan1=0, Scan2=1, CS=0, EM1=1, EM2=1 and EM3=1. The seventh switching transistor M7 turns on due to CS=0. The turning-on seventh switching transistor M7 can electrically conduct the first power supply terminal VDD and the first electrode of the driving transistor M0. The specific working process is basically the same as the working process in T331 in the third phase in the first embodiment, and will not be repeated here.

In the light emitting sub-phase T332, Reset=1, Scan1=1, Scan2=1, CS=0, EM1=1, EM2=1 and EM3=0. The seventh switching transistor M7 turns on due to CS=0. The turning-on seventh switching transistor M7 can electrically conduct the first power supply terminal VDD and the first electrode of the driving transistor M0. The specific working process is basically the same as the working process in T332 in the third phase in the first embodiment and the blue light emitting device L_3 begins to emit light, which will not be repeated here.

In the first embodiment and the second embodiment, in the light emitting process of the above pixel driving circuit, in the light emitting phase T31, the red light emitting device can be controlled to emit light, and the green light emitting device and the blue light emitting device can be controlled not to emit light. In the light emitting phase T32, the green light emitting device can be controlled to emit light, and the red light emitting device and the blue light emitting device can be controlled not to emit light. In the light emitting phase T33, the blue light emitting device can be controlled to emit light, and the green light emitting device and the red light emitting device can be controlled not to emit light. That is to say that each light emitting device can be turned on sequentially. Therefore, by time-divisionally inputting the signal of the data signal terminal and time-divisionally electrically conducting the corresponding light emitting device, the function of time-divisionally driving a plurality of light emitting devices to emit light can be realized, so that the structure of the pixel driving circuit can be simplified, the space for setting the pixel driving circuit can be saved, and the aperture ratio of one pixel can be increased. In addition, in the second embodiment, by disposing the seventh switching transistor, the data writing bootstrap sub-phase and the light emitting sub-phase in each light emitting phase can be divided clearer, and the light emission of the pixel driving circuit can be controlled stably.

Figure 6:
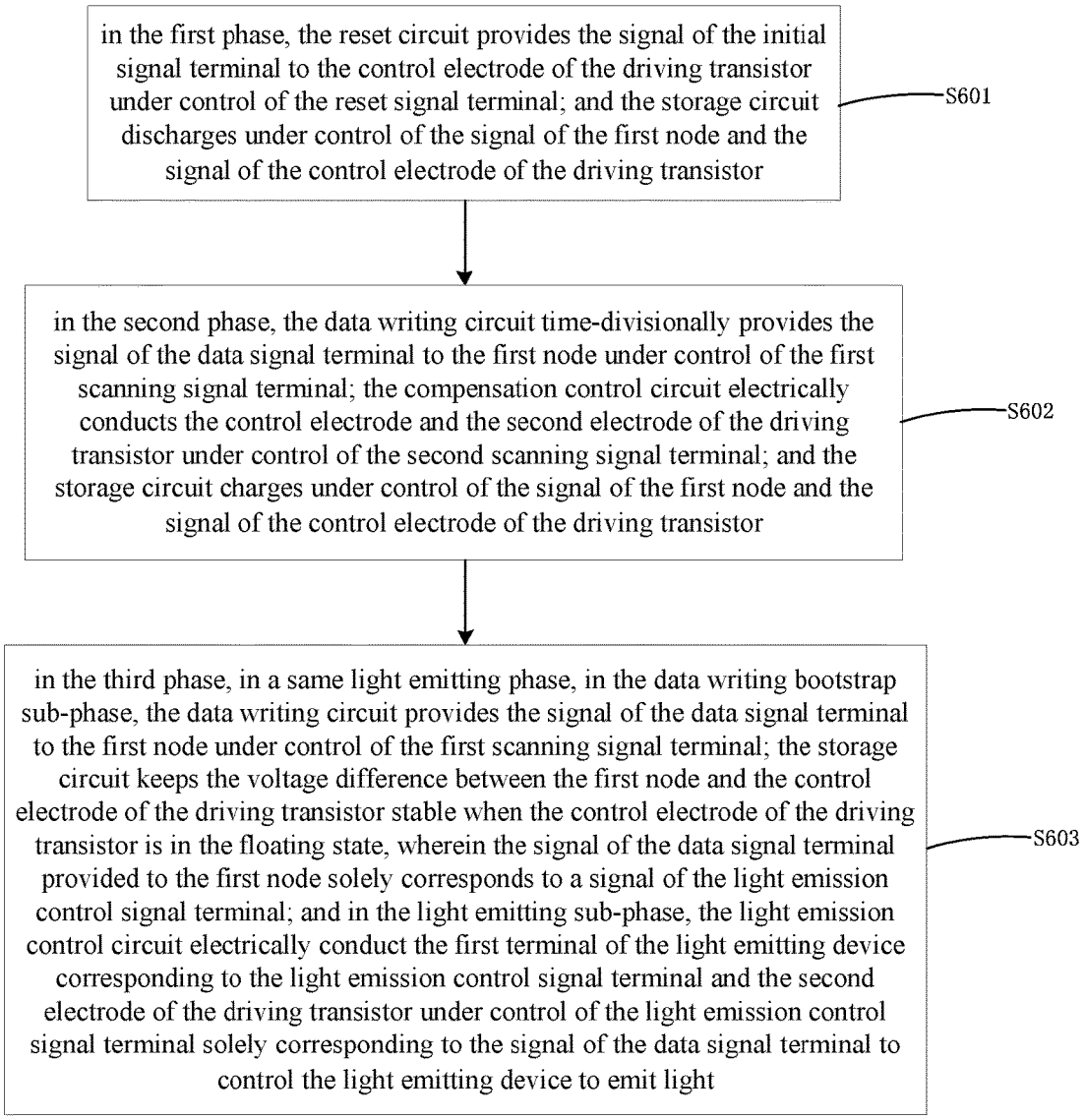
FIG. 6 is a flow chart of a driving method provided by an embodiment of the present disclosure.

The embodiments of the present disclosure also provide a driving method for any one of the above pixel driving circuits provided by the embodiments of the present disclosure, as illustrated in FIG. 6, which comprises a first phase, a second phase and a third phase. The third phase comprises a plurality of light emitting phases each having a data writing bootstrap sub-phase and a light emitting sub-phase.

S601: in the first phase, the reset circuit provides the signal of the initial signal terminal to the control electrode of the driving transistor under control of the reset signal terminal; and the storage circuit discharges under control of the signal of the first node and the signal of the control electrode of the driving transistor;

S602: in the second phase, the data writing circuit time-divisionally provides the signal of the data signal terminal to the first node under control of the first scanning signal terminal; the compensation control circuit electrically conducts the control electrode and the second electrode of the driving transistor under control of the second scanning signal terminal; and the storage circuit charges under control of the signal of the first node and the signal of the control electrode of the driving transistor; and S603: in the third phase, in a same light emitting phase, in the data writing bootstrap sub-phase, the data writing circuit provides the signal of the data signal terminal to the first node under control of the first scanning signal terminal; the storage circuit keeps the voltage difference between the first node and the control electrode of the driving transistor stable when the control electrode of the driving transistor is in the floating state, wherein the signal of the data signal terminal provided to the first node solely corresponds to a signal of the light emission control signal terminal; and in the light emitting sub-phase, the light emission control circuit electrically conduct the first terminal of the light emitting device corresponding to the light emission control signal terminal and the second electrode of the driving transistor under control of the light emission control signal terminal solely corresponding to the signal of the data signal terminal to control the light emitting device to emit light.

The above driving method provided by an embodiment of the present disclosure can time-divisionally input the signal of the data signal terminal though the data writing circuit, and time-divisionally, electrically conduct each light emitting device and the second electrode of the driving transistor through the light emission control circuit, so as to realize the function of driving a plurality of light emitting devices to time-divisionally emit light, so that the structure of the pixel driving circuit can be simplified, the space for setting the pixel driving circuit can be saved, the aperture ratio of a pixel can be increased, and the PPI of the display panel can be increased.

In at least one example, in the above driving method provided by an embodiment of the present disclosure, when the pixel driving circuit comprises a red light emitting device, a green light emitting device and a blue light emitting device, and the light emission control circuit comprises a red light emission control sub-circuit, a green light emission control sub-circuit and a blue light emission control sub-circuit, the third phase may comprise the following sections.

The first light emitting phase comprises a data writing bootstrap sub-phase and a light emitting sub-phase. In the data writing bootstrap sub-phase, the data writing circuit provides the signal of the data signal terminal to the first node under control of the first scanning signal terminal; and the storage circuit keeps the voltage difference between the first node and the control electrode of the driving transistor stable when the control electrode of the driving transistor is in the floating state, wherein the signal of the data signal terminal provided to the first node solely corresponds to the signal of the red light emission control signal terminal. In the light emitting sub-phase, the red light emission control sub-circuit electrically conducts the first terminal of the red light emitting device and the second electrode of the driving transistor under control of the red light emission control signal terminal to control the red light emitting device to emit light.

The second light emitting phase comprises a data writing bootstrap sub-phase and a light emitting sub-phase. In the data writing bootstrap sub-phase, the data writing circuit provides the signal of the data signal terminal to the first node under control of the first scanning signal terminal; and the storage circuit keeps the voltage difference between the first node and the control electrode of the driving transistor stable when the control electrode of the driving transistor is in the floating state, wherein the signal of the data signal terminal provided to the first node solely corresponds to the signal of the green light emission control signal terminal. In the light emitting sub-phase, the green light emission control sub-circuit electrically conducts the first terminal of the green light emitting device and the second electrode of the driving transistor under control of the green light emission control signal terminal to control the green light emitting device to emit light.

The third light emitting phase comprises a data writing bootstrap sub-phase and a light emitting sub-phase. In the data writing bootstrap sub-phase, the data writing circuit provides the signal of the data signal terminal to the first node under control of the first scanning signal terminal; and the storage circuit keeps the voltage difference between the first node and the control electrode of the driving transistor stable when the control electrode of the driving transistor is in the floating state, wherein the signal of the data signal terminal provided to the first node solely corresponds to the signal of the blue light emission control signal terminal. In the light emitting sub-phase, the blue light emission control sub-circuit electrically conducts the first terminal of the blue light emitting device and the second electrode of the driving transistor under control of the blue light emission control signal terminal to control the blue light emitting device to emit light.

Certainly, the third phase is not limited to the sequence of being electrically conducted in the order of the red light emitting device, the green light emitting device, and the blue light emitting device as described above, but these light emitting devices may also be electrically conducted in other control order, for example, be electrically conducted in the order of the green light emitting device, the red light emitting device, and the blue light emitting device.

Third Embodiment

Figure 7A:
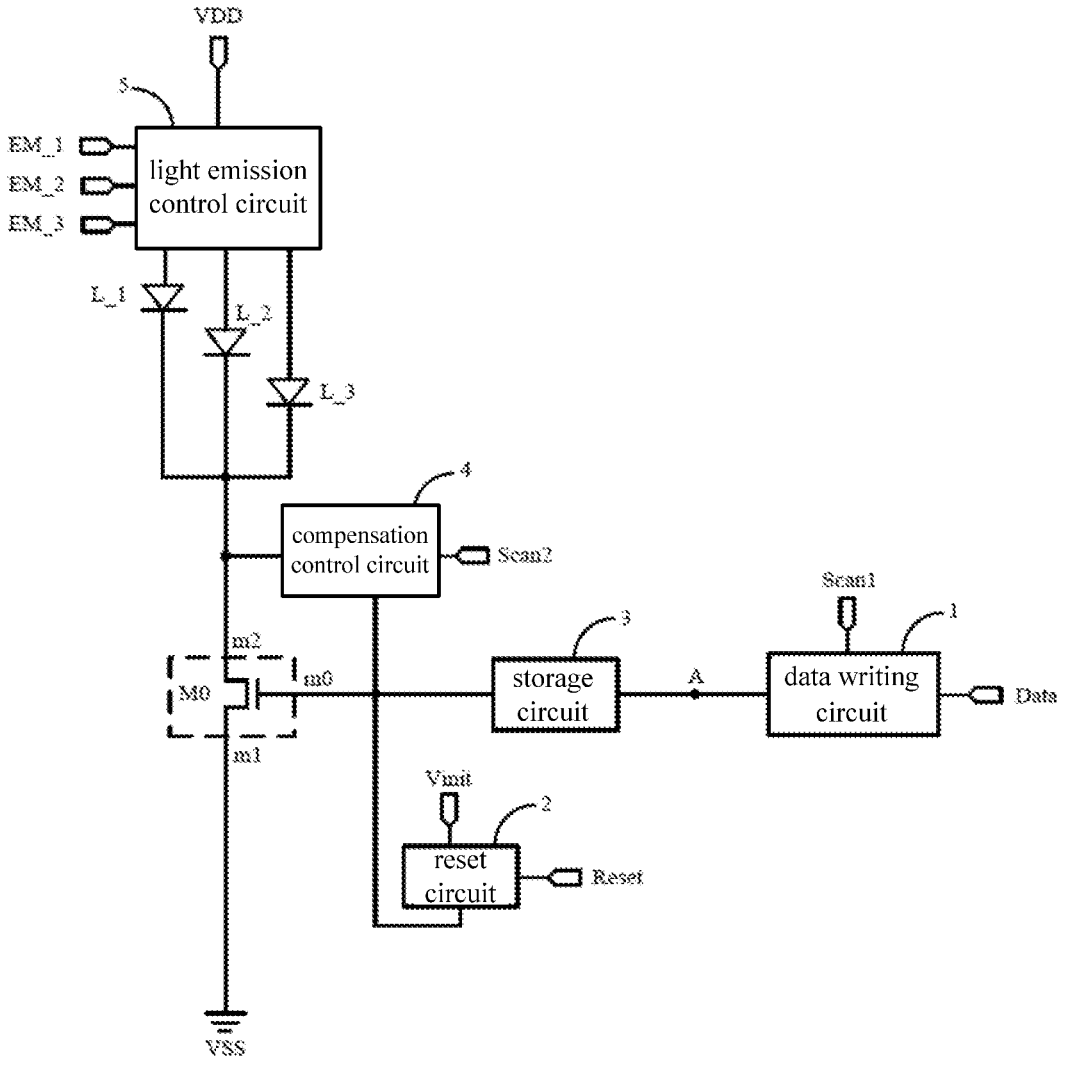
FIG. 7A is one of structural schematic diagrams of a pixel driving circuit provided by another embodiment of the present disclosure.

This embodiment provides a pixel driving circuit, for example, which can be used for OLED display panels. As illustrated in FIG. 7A (it is taken as an example that m=1, 2, and 3 in FIG. 7A), the pixel driving circuit comprises: the data writing circuit 1, the reset circuit 2, the storage circuit 3, the compensation control circuit 4, the light emission control circuit 5, the driving transistor M0 and a plurality of light emitting devices L_m (m is an integer greater than or equal to 1). Compared with the embodiment illustrated in FIG. 1A, the driving transistor M0 is an N-type transistor in this embodiment.

The first electrode m1 of the driving transistor M0 is connected to the second power supply terminal VSS.

The data writing circuit 1 is respectively connected to the first scanning signal terminal Scan1, the data signal terminal Data, and the first node A; and the data writing circuit 1 is configured to time-divisionally provide the signal of the data signal terminal Data to the first node A under control of the first scanning signal terminal Scan1.

The reset circuit 2 is respectively connected to the reset signal terminal Reset, the initial signal terminal Vinit and the control electrode m0 of the driving transistor M0; and the reset circuit 2 is configured to provide the signal of the initial signal terminal Vinit to the control electrode m0 of the driving transistor M0 under control of the reset signal terminal Reset.

The storage circuit 3 is respectively connected to the first node A and the control electrode m0 of the driving transistor M0; and the storage circuit 3 is configured to charge or discharge under control of the signal of the first node A and the signal of the control electrode m0 of the driving transistor M0, and keep the voltage difference between the first node A and the control electrode m0 of the driving transistor M0 stable when the control electrode m0 of the driving transistor M0 is in the floating state.

The compensation control circuit 4 is respectively connected to the second scanning signal terminal Scan2, the control electrode m0 of the driving transistor M0, and the second electrode m2 of the driving transistor M0; and the compensation control circuit 4 is configured to electrically conduct the control electrode m0 and the second electrode m2 of the driving transistor M0 under control of the second scanning signal terminal Scan2.

The light emission control circuit 5 is respectively connected to the light emission control signal terminal EM_m corresponding to each light emitting device L_m, the second electrode m2 of the driving transistor M0 and the first terminal of each light emitting device L_m, and the second terminal of each light emitting device L_m is connected to the first power supply terminal VDD; and the light emission control circuit 5 is configured to time-divisionally electrically conduct the first terminal of the light emitting device L_m corresponding to each light emission control signal terminal EM_m and the second electrode m2 of the driving transistor M0 under control of each light emission control signal terminal EM_m to control the light emitting device L_m to emit light.

The above pixel driving circuit provided by this embodiment comprises: the data writing circuit, the reset circuit, the storage circuit, the compensation control circuit, the light emission control circuit, the driving transistor and a plurality of light emitting devices. Through the cooperation of the above five circuits and the driving transistor, the pixel driving circuit can time-divisionally input the signal of the data signal terminal through the data writing circuit, and time-divisionally and electrically conduct each light emitting device and the second electrode of the driving transistor through the light emission control circuit, thereby realizing the function of controlling a plurality of light emitting devices to time-divisionally emit light, so that the structure of the pixel driving circuit can be simplified, the space for setting the pixel driving circuit can be saved, and the aperture ratio of the pixel can be increased.

Similarly, the above pixel driving circuit provided by this embodiment can also make the operating electric current of the driving transistor in the pixel driving circuit to drive the light emitting device to emit light only relevant to the voltage of the data signal terminal, and not relevant to the threshold voltage of the driving transistor and the voltage of the first power supply terminal. It can avoid the influence of the threshold voltage of the driving transistor and the IR drop on the operating electric current flowing through the light emitting device, so that the operating electric current to drive the light emitting device to emit light can be kept stable, and the uniformity of the luminance of the displayed image in the display panel can be improved.

Figure 7B:
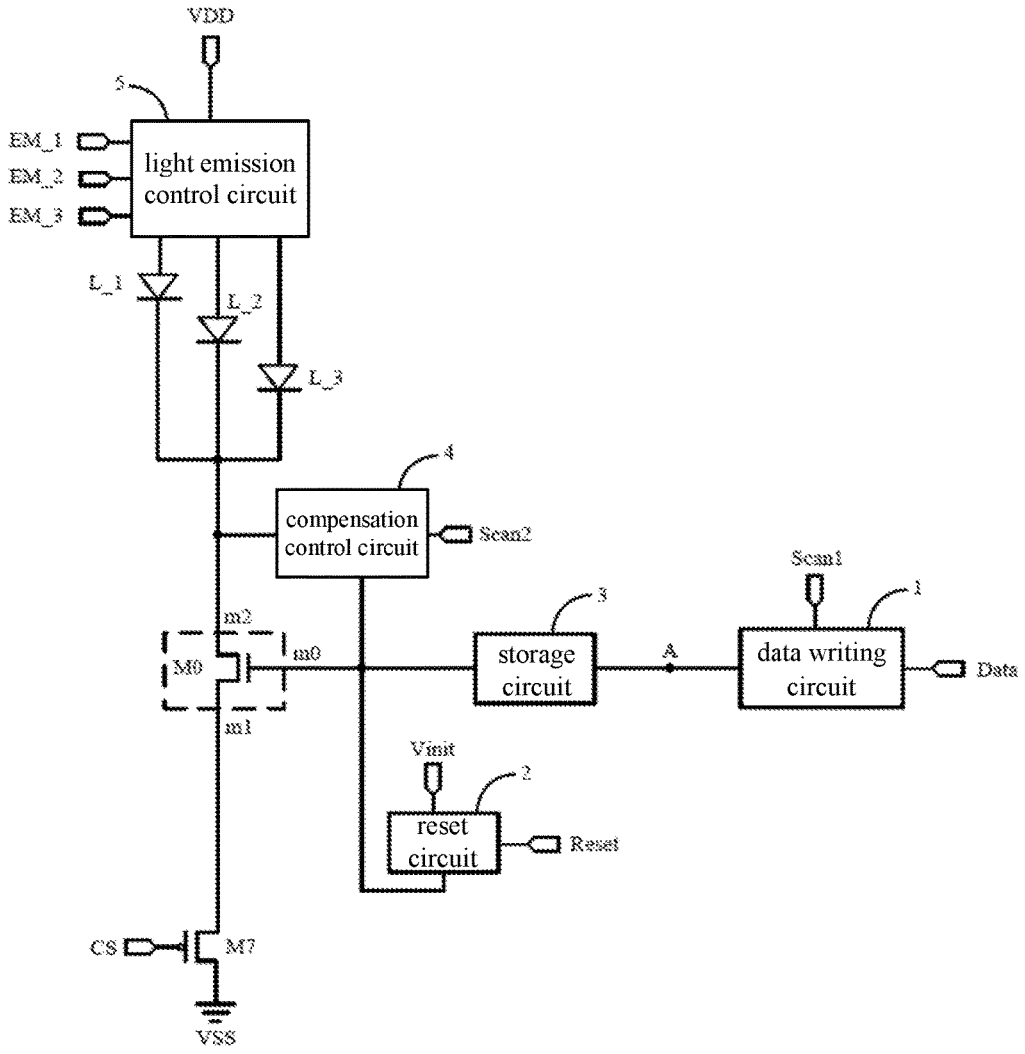
FIG. 7B is another one of structural schematic diagrams of a pixel driving circuit provided by another embodiment of the present disclosure.

For the purpose of stably controlling every phase of the pixel driving circuit in at least one example in the above pixel driving circuit provided by this embodiment, as illustrated in FIG. 7B, another example may further comprise: the seventh switching transistor M7; and the first power supply terminal VDD is connected to the first electrode m1 of the driving transistor M0 through the seventh switching transistor M7.

The control electrode of the seventh switching transistor M7 is connected to the writing control signal terminal CS, the first electrode of the seventh switching transistor M7 is connected to the second power supply terminal VSS, and the second electrode of the seventh switching transistor M7 is connected to the first electrode m1 of the driving transistor M0.

In at least one example, in the above pixel driving circuit provided by this embodiment, as illustrated in FIG. 7B, the seventh switching transistor M7 may be a P-type switching transistor. Certainly, the seventh switching transistor M7 may also be an N-type switching transistor, and it is not limited thereto.

In at least one example, in the above pixel driving circuit provided by an embodiment of the present disclosure, when the seventh switching transistor is in turning-on state under control of the writing control signal terminal, the signal of the second power supply terminal is provided to the first electrode of the driving transistor.

In at least one example, in the above pixel driving circuit provided by an embodiment of the present disclosure, the first terminal of the light emitting device is a negative electrode, and the second terminal of the light emitting device is a positive electrode. In addition, the light emitting device is generally an organic light emitting diode which achieves light emission under the effect of the electric current of the driving transistor when it is in the saturated state.

In at least one example, in the above pixel driving circuit provided by an embodiment of the present disclosure, the voltage $V_{dd}$ of the first power supply terminal is generally positive, and the voltage $V_{ss}$ of the second power supply terminal is generally grounded or negative.

In this embodiment, the driving transistor M0 is an N-type transistor, which turns on when a high level voltage is applied to the control terminal m0 and turns off when a low level voltage is applied to the control terminal m0. The first terminal m1 is a drain electrode, and accordingly the second terminal m2 is a source electrode. When the N-type transistor is in a saturated state, the electric current flows from the drain electrode to the source electrode of the N-type transistor, and the threshold voltage $V_{th}$ of the N-type transistor is generally a positive value.

In this embodiment, the specific implementation of the data writing circuit 1, the reset circuit 2, the storage circuit 3, the compensation control circuit 4, the light emission control circuit 5 and a plurality of light emitting devices L_m may refer to the foregoing specific implementation as illustrated in FIG. 2A, FIG. 2B, FIG. 3A, FIG. 3B, FIG. 4A and FIG. 4B, and will not be repeated here. Meanwhile, the pixel driving method in the above embodiments may also refer to the timing diagrams as illustrated in FIGS. 5A and 5B, and will not be repeated here either.

Embodiments of the present disclosure also provide a display panel, which comprises any one of the above pixel driving circuits provided by embodiments of the present disclosure. The principle of the display panel to solve the problem is similar to that of the foregoing pixel driving circuit. Therefore, the implementation of the display panel may refer to the implementation of the foregoing pixel driving circuit, and the duplicate content will not be repeated here.

Fourth Embodiment

The embodiment of the present disclosure also provides a display panel, which comprises the pixel driving circuit provided by the above first embodiment of the present disclosure.

Figure 8:
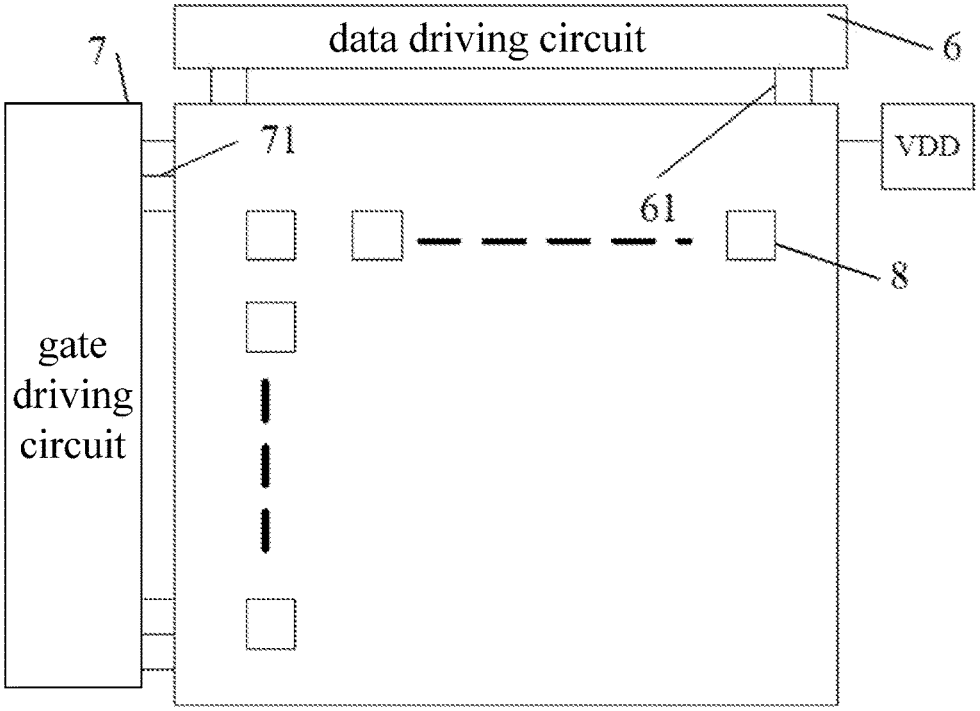
FIG. 8 is a schematic diagram of a display panel provided by an embodiment of the present disclosure.

FIG. 8 is a schematic diagram of a display panel provided by this embodiment. The display panel comprises an array constituted by a plurality of pixel units 8, and each pixel unit 8 comprises at least two sub-pixels, for example, two sub-pixels, three sub-pixels or the like.

The display panel may also comprise a data driving circuit 6 and a gate driving circuit 7. The data driving circuit 6 is configured to respectively provide a data signal; and the gate driving circuit 7 is configured to provide scanning signals (such as Scan1~Scan3) or gate signals, and may further be configured to provide a plurality of control signals (such as signals Em1~Em2). The data driving circuit 6 is electrically connected to the pixel unit 8 through data line 61, and the gate driving circuit 7 is electrically connected to the pixel unit 8 through gate line 71. The data driving circuit 6 and the gate driving circuit 7 may be implemented as semiconductor chips.

The display panel may further comprise other components, such as a timing controller, a signal decoding circuit, a voltage conversion circuit, and the like. For example, these components may use existing conventional components and will not be described in detail here.

In at least one example, when the light emitting devices are OLEDs, the display panel provided by an embodiment of the present disclosure may be an organic electroluminescent display panel.

In the specific implementation, the display panel provided by an embodiment of the present disclosure may be any product or component having a display function such as a mobile phone, a tablet computer, a television set, a displayer, a notebook computer, a digital photo frame, a navigator, and the like. The other essential components of the display panel are understood by those skilled in the art, which are not described here, and should not be construed as a limitation of the present disclosure.

At least one embodiment of the present disclosure provides a pixel driving circuit and driving method thereof, and a display panel. The pixel driving circuit comprises: a data writing circuit, a reset circuit, a storage circuit, a compensation control circuit, a light emission control circuit, a driving transistor and a plurality of light emitting devices. Through the cooperation of the above five circuits and the driving transistor, the pixel driving circuit can time-divisionally input the signal of the data signal terminal through the data writing circuit, and time-divisionally and electrically conduct each light emitting device and the second electrode of the driving transistor through the light emission control circuit, thereby realizing the function of controlling a plurality of light emitting devices to time-divisionally emit light, so that the structure of the pixel driving circuit can be simplified, the space for setting the pixel driving circuit can be saved, the aperture ratio of the pixel can be increased, and the PPI of the display panel can be increased. In addition, in the pixel driving circuit provided by embodiments of the present disclosure, the operating electric current of the driving transistor to drive the light emitting device to emit light is only relevant to the voltage of the data signal terminal, and is not relevant to the threshold voltage of the driving transistor and the voltage of the first power supply terminal. It can avoid the influence of the threshold voltage of the driving transistor and the IR drop on the operating electric current flowing through the light emitting device, so that the operating electric current to drive the light emitting device to emit light can be kept stable, and the uniformity of the luminance of the displayed image in the display panel can be improved.

What are described above is related to the illustrative embodiments of the disclosure only and not limitative to the scope of the disclosure; the scopes of the disclosure are defined by the accompanying claims.

The application claims priority to the Chinese patent application No. 201710079035.2, filed on Feb. 14, 2017, the entire disclosure of which is incorporated herein by reference as part of the present application.

What is claimed is:

1. A pixel driving circuit, comprising: a data writing circuit, a reset circuit, a storage circuit, a compensation control circuit, a light emission control circuit, a driving transistor, and a plurality of light emitting devices;

wherein the data writing circuit is configured to provide a data signal of a data signal terminal to the storage circuit;

the reset circuit is configured to reset a control electrode of the driving transistor;

the storage circuit is configured to store the data signal and a threshold voltage of the driving transistor;

the compensation control circuit is configured to electrically conduct the control electrode of the driving transistor and a second electrode of the driving transistor, so that the storage circuit is capable of storing the threshold voltage of the driving transistor to compensate the driving transistor;

a first electrode of the driving transistor is configured to be connected to a first power supply terminal; and the light emission control circuit is configured to be connected to light emission control signal terminals one-to-one corresponding to the light emitting devices, the second electrode of the driving transistor and a first terminal of each of the light emitting devices, a second terminal of each of the light emitting devices is connected to a second power supply terminal, and the light emission control circuit is configured to time-divisionally electrically conduct the first terminals of the light emitting devices respectively corresponding to the light emission control signal terminals and the second electrode of the driving transistor under control of each of the light emission control signal terminals to control the light emitting devices to emit light.

2. The pixel driving circuit according to claim 1, wherein the data writing circuit is configured to be respectively connected to a first scanning signal terminal, the data signal terminal and a first node, and time-divisionally provide the data signal of the data signal terminal to the first node under control of the first scanning signal terminal;

the reset circuit is configured to be respectively connected to a reset signal terminal, an initial signal terminal and the control electrode of the driving transistor, and provide a signal of the initial signal terminal to the control electrode of the driving transistor under control of the reset signal terminal;

the storage circuit is configured to be respectively connected to the first node and the control electrode of the driving transistor, charge or discharge under control of a signal of the first node and a signal of the control electrode of the driving transistor, and keep a voltage difference between the first node and the control electrode of the driving transistor stable when the control electrode of the driving transistor is in a floating state; and the compensation control circuit is configured to be respectively connected to a second scanning signal terminal, the control electrode of the driving transistor and the second electrode of the driving transistor, and electrically conduct the control electrode of the driving transistor and the second electrode of the driving transistor under control of the second scanning signal terminal.

3. The pixel driving circuit according to claim 2, wherein each of the light emitting devices corresponds to a sub-pixel, and the light emission control circuit comprises: light emission control sub-circuits one-to-one corresponding to light emitting devices;

wherein each light emission control sub-circuit is respectively connected to the first terminal of the corresponding light emitting device, the light emission control signal terminal corresponding to the corresponding light emitting device and the second electrode of the driving transistor; and the light emission control sub-circuit is configured to electrically conduct the second electrode of the driving transistor and the first terminal of the connected light emitting device under control of the connected light emission control signal terminal.

4. The pixel driving circuit according to claim 3, wherein the light emitting devices comprise: a red light emitting device, a green light emitting device, and a blue light emitting device;

the light emission control circuits comprise a red light emission control sub-circuit, a green light emission control sub-circuit and a blue light emission control sub-circuit;

the light emission control signal terminals comprise a red light emission control signal terminal, a green light emission control signal terminal and a blue light emission control signal terminal;

the red light emission control sub-circuit is respectively connected to a first terminal of the red light emitting device, the red light emission control signal terminal corresponding to the red light emitting device and the second electrode of the driving transistor; and the red light emission control sub-circuit is used to electrically conduct the first terminal of the red light emitting device and the second electrode of the driving transistor under control of the red light emission control signal terminal;

the green light emission control sub-circuit is respectively connected to a first terminal of the green light emitting device, the green light emission control signal terminal corresponding to the green light emitting device and the second electrode of the driving transistor; and the green light emission control sub-circuit is used to electrically conduct the first terminal of the green light emitting device and the second electrode of the driving transistor under control of the green light emission control signal terminal; and the blue light emission control sub-circuit is respectively connected to a first terminal of the blue light emitting device, the blue light emission control signal terminal corresponding to the blue light emitting device and the second electrode of the driving transistor; and the blue light emission control sub-circuit is used to electrically conduct the first terminal of the blue light emitting device and the second electrode of the driving transistor under control of the blue light emission control signal terminal.

5. The pixel driving circuit according to claim 4, wherein the red light emission control sub-circuit comprises: a first switching transistor; and a control electrode of the first switching transistor is connected to the red light emission control signal terminal, a first electrode of the first switching transistor is connected to the second electrode of the driving transistor, and a second electrode of the first switching transistor is connected to the first terminal of the red light emitting device.

6. The pixel driving circuit according to claim 4, wherein the green light emission control sub-circuit comprises: a second switching transistor; and a control electrode of the second switching transistor is connected to the green light emission control signal terminal, a first electrode of the second switching transistor is connected to the second electrode of the driving transistor, and a second electrode of the second switching transistor is connected to the first terminal of the green light emitting device.

7. The pixel driving circuit according to claim 4, wherein the blue light emission control sub-circuit comprises: a third switching transistor; and a control electrode of the third switching transistor is connected to the blue light emission control signal terminal, a first electrode of the third switching transistor is connected to the second electrode of the driving transistor, and a second electrode of the third switching transistor is connected to the first terminal of the blue light emitting device.

8. The pixel driving circuit according to claim 1, wherein the data writing circuit comprises: a fourth switching transistor; and a control electrode of the fourth switching transistor is connected to the first scanning signal terminal, a first electrode of the fourth switching transistor is connected to the data signal terminal, and a second electrode of the fourth switching transistor is connected to the first node.

9. The pixel driving circuit according to claim 1, wherein the reset circuit comprises: a fifth switching transistor; and a control electrode of the fifth switching transistor is connected to the reset signal terminal, a first electrode of the fifth switching transistor is connected to the initial signal terminal, and a second electrode of the fifth switching transistor is connected to the control electrode of the driving transistor.

10. The pixel driving circuit according to claim 1, wherein the compensation control circuit comprises: a sixth switching transistor; and a control electrode of the sixth switching transistor is connected to the second scanning signal terminal, a first electrode of the sixth switching transistor is connected to the control electrode of the driving transistor, and a second electrode of the sixth switching transistor is connected to the second electrode of the driving transistor.

11. The pixel driving circuit according to claim 1, wherein the storage circuit comprises a capacitor; and the capacitor is connected between the first node and the control electrode of the driving transistor.

12. The pixel driving circuit according to claim 1, further comprising: a seventh switching transistor;

wherein the first power supply terminal is connected to the first electrode of the driving transistor through the seventh switching transistor; and a control electrode of the seventh switching transistor is connected to a writing control signal terminal, a first electrode of the seventh switching transistor is connected to the first power supply terminal, and a second electrode of the seventh switching transistor is connected to the first electrode of the driving transistor.

13. The pixel driving circuit according to claim 1, wherein the driving transistor is a P-type transistor or an N-type transistor.

14. A display panel, comprising the pixel driving circuit according to claim 1.

15. A driving method of the pixel driving circuit according to claim 1, comprising: a first phase, a second phase and a third phase;

wherein the third phase comprises light emitting phases each having a data writing bootstrap sub-phase and a light emitting sub-phase;

in the first phase, the reset circuit resets the control electrode of the driving transistor;

in the second phase, the data writing circuit provides an initial data signal provided by the data signal terminal to the storage circuit, and the compensation control circuit electrically conducts the control electrode and the second electrode of the driving transistor, so that the storage circuit stores a threshold voltage of the driving transistor;

in the third phase, during each of the light emitting phases, in the data writing bootstrap sub-phase, the data writing circuit provides a light emitting data signal provided by the data signal terminal to the storage circuit; and the storage circuit applies a driving voltage on a basis of the initial data signal, the light emitting data signal and the threshold voltage to a gate electrode of the driving transistor; and in the light emitting sub-phase, the light emission control circuit electrically conducts a first terminal of the light emitting device corresponding to the light emission control signal terminal and the second electrode of the driving transistor under control of the light emission control signal terminal corresponding to the light emitting data signal of the data signal terminal to control the light emitting device to emit light.

* * * * *